US006854619B2

(12) United States Patent
Knickerbocker

(10) Patent No.: US 6,854,619 B2
(45) Date of Patent: Feb. 15, 2005

(54) FLIP-TOP CLOSURE WITH CHILD RESISTANT PACKAGING SYSTEM

(75) Inventor: Michael G. Knickerbocker, Saint George, UT (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 10/274,663

(22) Filed: Oct. 18, 2002

(65) Prior Publication Data

US 2004/0074919 A1 Apr. 22, 2004

(51) Int. Cl.[7] ..... G01F 11/00

(52) U.S. Cl. ..... 222/1; 222/153.14; 222/546; 222/556

(58) Field of Search ..... 222/1, 153.07, 222/153.14, 212, 546, 556, 563

(56) References Cited

U.S. PATENT DOCUMENTS

| | | | | |
|---|---|---|---|---|
| 3,603,470 A | | 9/1971 | Armour | 215/9 |
| 4,022,352 A | | 5/1977 | Pehr | 222/153 |
| 4,127,221 A | * | 11/1978 | Vere | 222/153.02 |
| 4,170,315 A | | 10/1979 | Dubach et al. | 220/281 |
| 4,244,495 A | | 1/1981 | Lorscheid et al. | |
| 4,533,058 A | | 8/1985 | Uhlig | 215/216 |
| 4,629,081 A | | 12/1986 | McLaren | 215/206 |
| 4,718,567 A | | 1/1988 | La Vange | 215/216 |
| 4,739,906 A | | 4/1988 | LoTurco | 222/153 |
| 4,787,526 A | | 11/1988 | Pehr | 215/216 |
| 4,790,442 A | | 12/1988 | Gach | 215/216 |
| 4,809,874 A | | 3/1989 | Pehr | 220/338 |
| 4,821,898 A | | 4/1989 | Smalley | 215/216 |
| 4,838,441 A | | 6/1989 | Chernack | 215/216 |
| 4,852,770 A | | 8/1989 | Sledge et al. | |
| 4,892,208 A | | 1/1990 | Sledge | 215/216 |
| 4,984,716 A | * | 1/1991 | Beck | 222/153.07 |
| 5,092,493 A | | 3/1992 | Pehr | 222/153 |
| 5,141,138 A | | 8/1992 | Odet et al. | 222/541 |
| 5,246,145 A | | 9/1993 | Leoncavallo et al. | 222/153 |
| 5,328,058 A | | 7/1994 | Leoncavallo et al. | 222/153 |
| 5,484,070 A | | 1/1996 | Graham | 215/223 |
| 5,579,957 A | | 12/1996 | Gentile et al. | |
| 5,765,705 A | | 6/1998 | Deubel | 215/216 |
| 6,095,354 A | | 8/2000 | Herr et al. | 215/225 |
| 6,371,316 B1 | | 4/2002 | Herr et al. | 215/204 |

* cited by examiner

*Primary Examiner*—Joseph A. Kaufman
(74) *Attorney, Agent, or Firm*—Davis & Bujold, P.L.L.C.

(57) ABSTRACT

A flip-top closure, for dispensing a product from a container, comprising a base member having a neck and a dispensing orifice. A cap is formed integral with the base member and connected thereto by a hinge which facilitates pivoting motion of the cap relative to the base member. The cap is pivotable from an open position to a closed position, and vice versa. The cap carries a sealing member which facilitates sealing of the dispensing orifice when the cap is in the closed position. The flip-top closure includes a child resistant locking system, which resists opening of the flip-top container by a child, comprising at least one hook member carried by one of the base member and the cap and at least one latching surface, carried by the other of the base member and the cap. The hook member is located to engage with the latching surface and retain the cap in a locked position and resist opening of the flip-top container by a child.

26 Claims, 14 Drawing Sheets

FLIP-TOP CLOSURE WITH CHILD RESISTANT PACKAGING SYSTEM

FIELD OF THE INVENTION

The present invention relates to a child resistant packaging system for a flip-top closure.

BACKGROUND OF THE INVENTION

Currently available in the marketplace, there are a variety of designs for flip-top closures as well as numerous applications for such closures. Such flip-top closures are used to facilitate dispensing of a variety of different products. One drawback associated with currently available flip-top closures is that they can be easily opened by a child and the contents, contained within the container, can be readily dispensed by the child opening the flip-top closure. Depending upon the contents of the container, if the contents of the container are hazardous and if the child were to contact such hazardous contents with his or her eyes or were in ingest the same, the child could be injured, poisoned, or possibly be killed.

The United States Government recently pass the Poison Prevention Packaging Act and this legislation will become effective in October of 2002. As a result of this legislation, if a flip-top closure is to be used for dispensing either a chemical or a cosmetic product, it will be necessary for the flip-top closure to have a child resistant packaging feature.

According to government regulations, a child resistant package is one that is designed or constructed to be significantly difficult for children under five to open or obtain a harmful amount of the contents of the child resistant package within a reasonable time. In addition, the child resistant package must also not be too difficult for a "normal" adult to use properly and dispense product therefrom.

SUMMARY OF THE INVENTION

Wherefore, it is an object of the present invention to overcome the above mentioned shortcomings and drawbacks associated with the prior art flip-top closures.

Another object of the present invention to provide a flip-top closure with a child resistant packaging system which prevents a child from inadvertently accessing the product contents or opening the flip-top closure and dispensing a potentially harmful amount of the product contents therefrom.

A further object of the present invention is to provide a flip-top closure which requires a dual action opening sequence in order for the user to unlock the child resistant safety system and open the flip-top closure before dispensing the product contents out through a dispensing orifice provided in the flip-top closure.

Still another object of the present invention is to provide a child resistant packaging system which is relatively easy and inexpensive to manufacture while reliable in preventing an infant or child from either opening the child resistant packaging or, if partially opened, preventing access to a potentially harmful amount of the product contents contained within the package.

Yet another object of the present invention is to minimize the amount modifications required to adapt conventional flip-top closures so that the currently available flip-top closure molds can be quickly, easily and relatively inexpensively modified to include the child resistant packaging system according to the present invention.

The present invention also relates to a flip-top closure for dispensing a product from a container, the flip-top closure comprising: a base member having a neck facilitating attachment of the base member to a desired container, and the base member having a dispensing orifice communicating with the neck to facilitate dispensing product from a container; a cap formed integral with the base member and connected thereto by a hinge which facilitates pivoting motion of the cap relative to the base member, and the cap being pivotable from an open position to a closed position and from the closed position to the open position; and the cap carrying a sealing member which facilitates sealing of the orifice when the cap is in the closed position; wherein the flip-top closure includes a child resistant locking system which resists opening of the flip-top container by a child, the child resistant locking system comprises at least one hook member carried by one of the base member and the cap and at least one latching surface, carried by the other of the base member and the cap, and the at least one hook member is located to engage with the at least one latching surface to retain the cap in a locked position and resist opening of the flip-top container by a child when the cap is in the closed position.

The present invention also relates to a method of providing a child resistant locking system for a flip-top closure, the method comprising the steps of: providing a base member with a neck facilitating attachment of the base member to a desired container, and forming a dispensing orifice in the base member communicating with the neck to facilitate dispensing product from a container; forming a cap integral with the base member via a hinge which facilitates pivoting motion of the cap relative to the base member, and the cap being pivotable from an open position to a closed position and from the closed position to the open position; providing the cap with a sealing member which facilitates sealing of the orifice when the cap is in the closed position; incorporating the child resistant locking system, which resists opening of the flip-top container by a child, into the flip-top closure by providing at least one hook member on one of the base member and the cap; and providing at least one latching surface, on the other of the base member and the cap, with the at least one hook member being located to engage with the at least one latching surface to retain the cap in a locked position and resist opening of the flip-top container by a child when the cap is in the closed position.

BRIEF DESCRIPTION OF THE DRAWINGS

The invention will now be described, by way of example, with reference to the accompanying drawings in which.

DETAILED DESCRIPTION OF THE INVENTION

Figure 1:
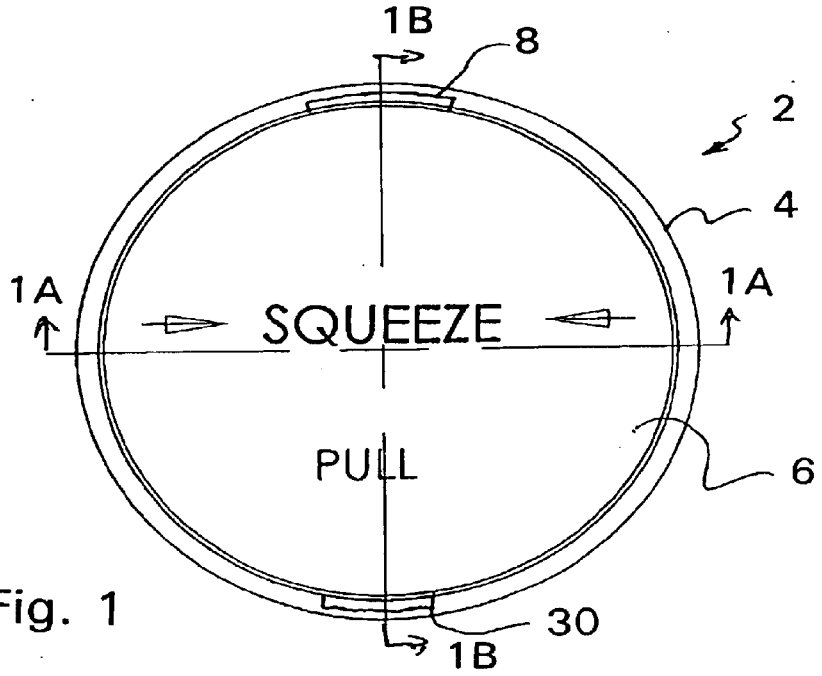
FIG. 1 is a diagrammatic top plan view of a first embodiment of a flip-top closure with a child resistant packaging system.
Figure 1A:
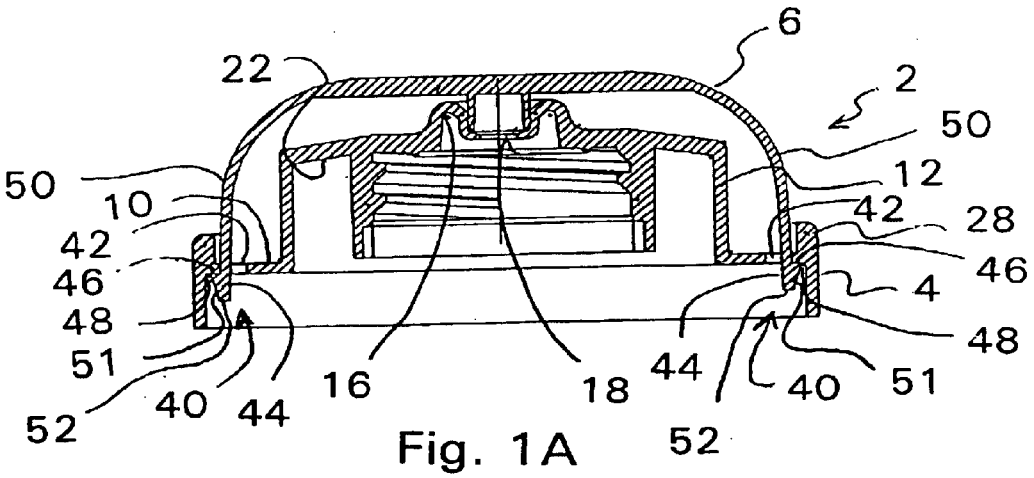
FIG. 1A is a diagrammatic cross sectional view along section line 1A—1A of FIG. 1.
Figure 1B:
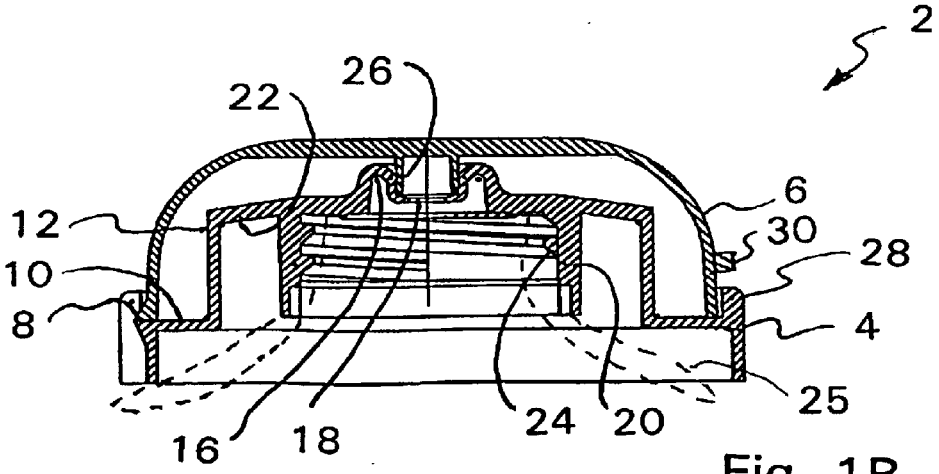
FIG. 1B is a diagrammatic cross sectional view along section line 1B—1B of FIG. 1.
Figure 1C:
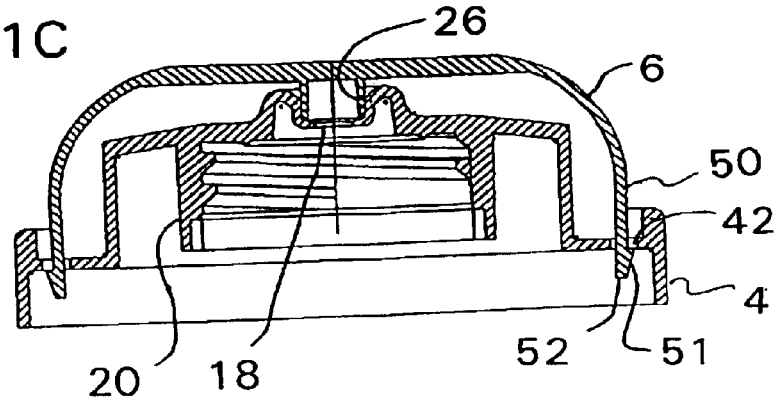
FIG. 1C is a diagrammatic cross sectional view, along section line 1A—1A of FIG. 1, showing the initial squeezing of the side walls of the cap to disengage the child resistant packaging system.
Figure 1D:
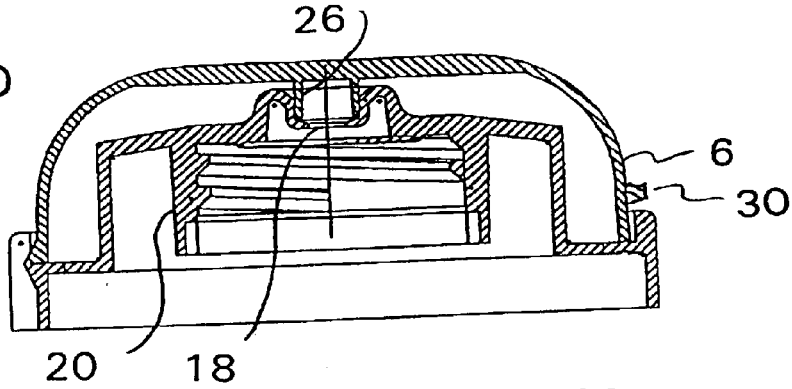
FIG. 1D is a diagrammatic cross sectional view, along section line 1B—1B of FIG. 1, showing the initial squeezing of the side walls of the cap to disengage the child resistant packaging system.
Figure 1E:
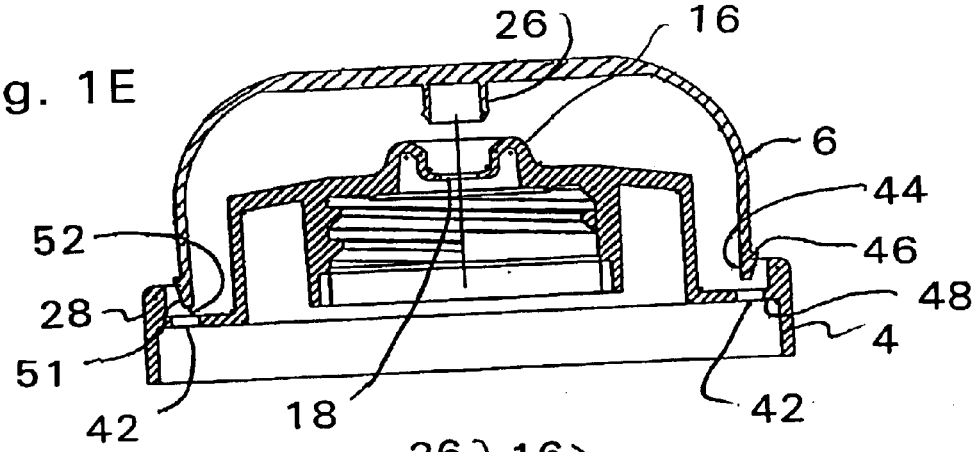
FIG. 1E is a diagrammatic cross sectional view, along section line 1A—1A of FIG. 1, showing an intermediate, partially pivoted position of cap relative to the base member.
Figure 1F:
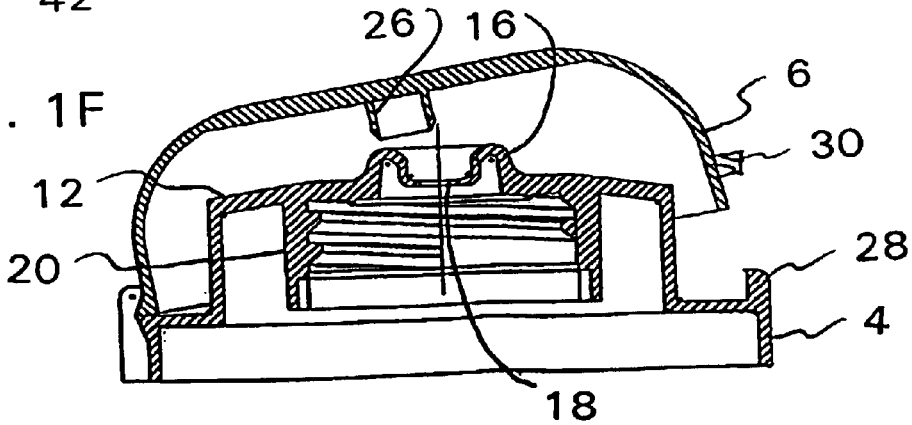
FIG. 1F is a diagrammatic cross sectional view, along section line 1B—1B of FIG. 1, showing an intermediate, partially pivoted position of cap relative to the base member.

Turning now to FIGS. 1–1F, a detailed description concerning the basic components of a conventional flip-top closure 2 will now be discussed. As can be seen in those Figures, the flip-top closure 2 generally comprises a circular base member 4 having a pivotable cap 6 attached thereto. A conventional "living" hinge 8 is integral formed with both the cap 6 with the base member 4 to facilitate pivoting movement of the cap 6 relative to the base member 4 from an open position (not shown) to a locked or closed position (FIGS. 1, 1A and 1B), and vice versa. The base member 4 generally comprises a substantially planar perimeter base surface 10 which has a contiguous elevated central section 12. An annular rim 16 is formed in the central most region of the central section 12 and the annular rim 16 defines a centrally located product discharge orifice 18.

A downwardly facing, lower surface 22 of the central section 12 has a cylindrical neck 20 formed thereon and the neck 20 has an interior thread 24 formed therein. The interior thread 24 of the neck 20 is designed to matingly engage with an exterior thread (not shown) provided on a complimentary neck of a desired bottle or container 25 (only partially diagrammatically shown) for securely attaching the base member 4 of the flip-top closure 2 to the desired container 25. Both the neck and the complimentary neck are provided with conventional non-removable locking mechanisms, which are is well known in the art, to prevent the flip-top closure 2 from being removed from the container 25 once connected thereto. It is to be appreciated that although the drawings show the retaining device to be a pair of mating threads, the neck 20 may be provided with an annular rib or some other protrusion which engages with and interlocks with a mating annular protrusion, or some other complimentary shape, provided on the neck of the container 25 to provide a secure and non-releasable attachment of the flip-top closure 2 to the neck of the container 25. Alternatively, a variety of other conventional and well known mating or complimentary permanent attachment designs, which are common in this art, may be utilized for securing the flip-top closure 2 to the bottle or container 25.

A centrally located plug or some other sealing member 26 is formed on an inwardly facing surface of the cap 6. The sealing member 26 is sized and shaped to have a slight interference fit with the orifice 18 of the base member 4 to provide a fluid tight sealing engagement therewith, when the cap 6 is in its closed position, and prevent the inadvertent dispensing of product contents of the container through the orifice 18. When the cap 6 is pivoted to its open position, via the hinge 8, the sealing member 26 is sufficiently spaced from the orifice 18 so that the orifice 18 is unobstructed and a desired amount of the product contents may be readily dispensed from the attached container 25 out through the orifice 18, by squeezing and/or inverting the container 25. The dispensing of the product contents through the orifice is possible until the cap 6 is again pivoted and returned back to its closed position where the sealing member 26 sealingly engages with the orifice 18. While the drawings of this application only show a single hinge 8 interconnecting the cap 6 with the base member 4, it is to be appreciated that a pair of similar spaced apart hinges may be utilized, instead of a single hinge, to facilitate pivoting of the cap 6 relative to the base member 4. Such modification to hinge member is considered to be within the spirit and scope of the present invention.

An annular skirt 28 extends from an outer periphery of the base surface 10 of the base member 4. A plurality of reinforcing members or ribs (not shown) may interconnect a radially outwardly facing surface of the neck 20 with a radially inwardly facing surface of the central section 12 as well as the downwardly facing surface 22 of the central section 12. Generally, the base member 4 is provided with between 4 to 8 reinforcing members or ribs and it is to be appreciated that the number, spacing and/or location of the reinforcing members or ribs can vary depending upon the particular application at hand.

The cap 6 is provided, at location generally opposite to the hinge 8, with a conventional latch, ridge or some other handle component 30 to facilitate a user gripping the cap 6 and pivoting the same to its open position and disengage the sealing member 26 from its sealing engagement with the orifice 18. As all of the above described flip-top closure features are common to all embodiments of the improved flip top closure discussed below, a further detail description concerning the same is not hereinafter provided.

With reference now to FIGS. 1–1F, a detailed description concerning a first embodiment of the child resistant packaging system 40, for use with the flip-top closure 2, will now be described. As can be seen in those Figures, the base surface 10 is provided with a pair of diametrically opposed apertures 42 formed therein while the cap 6 is provided with a pair of diametrically opposed mating hook members 44 which are located, when the cap 6 is pivoted to its close position, to pass through and be received by a respective one of the mating apertures 42. The hook members 44 having an outwardly facing latching ledge 46 that engage with a mating inwardly facing latching surface 48 formed by an undersurface of the base surface 10 to lockingly retain the cap 6 in its closed position. Due to this arrangement, if an infant, child or some other young individual were to attempt to open the flip top closure 2 by merely attempting to pivot the cap 6 to its open position (see FIGS. 1E and 1F), the latching ledge 46 would abut against the mating latching surface 48 and prevent the user from pivoting the cap 6 to its open position, i.e., that is, the sealing member 26 would remain sealingly engaged with the orifice 18.

In the event that dispensing of the product contents from the bottle or container 25 is desired by an appropriate user, e.g., a "normal" adult, the user squeezes the opposed sidewalls 50 of the cap 6 radially inwardly toward one another, adjacent the areas supporting the hook members 44, a sufficient distance, e.g., squeeze each sidewall 50 radially inward a quarter of an inch or so, so that both of the hook members 44 are simultaneously displaced radially inwardly by substantially the same amount due to their integral formation with the sidewalls 50. It is to be appreciated that the base surface 10 must not have any surfaces or protrusions that will inhibit the radial inward movement of the hook members 44 toward one another as such surface(s) or protrusion(s) will render the child resistant packaging system much more difficult for a normal adult to open. As a result of this squeezing action, the latching ledges 46 of the hook members 44 move radially inwardly toward one another so that they no longer are in abutting engagement with the mating latching surface 48 of the base surface 10. Once the latching ledges 46 of the hook members 44 are clear of the mating latching surfaces 48 of the base surface 10, the user can then readily pivot the cap 6, via the conventional handle component 30 and the hinge 8, into its open position in a conventional manner and dispense a desired amount of the product contents from the container 25, via the flip-top closure 2. After use of the product by the user is completed, the user merely pivots and returns the cap 6 back to its closed position where the sealing member 26 once again sealingly engages with the orifice 18.

Upon returning the cap 6 back to its closed position, the return motion of the cap 6 generally properly aligns the cap 6 with the base member 4 to facilitate automatically achieving a locking engagement between the latching ledge 46 and the mating latching surface 48 of the base surface 12. The cap 6 normally freely pivots toward is closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, an inclined surface 51 of each one of the hook members 44 biases the remote end 52 of each respective the hook member 44 radially inwardly toward one another until the remote ends 52 of the hook members 44 are sufficiently received by and located within the apertures 42 formed in the base member 4. Once the cap 6 is substantially returned back to its closed position by physical force, each hook member 44 extends within each mating aperture 42 a sufficient distance such that the inclined surface 51 of each respective hook member 44 is no longer abuttingly engaged with the base member 4. As a result of this, the remote ends 52 of the hook members 44 both spring radially outwardly, due to the inherent resiliency of the material from which the cap 6 and the hook members 44 are manufactured, so that the latching ledge 46 of each hook member 44 is again brought into locking engagement with the mating latching surface 48 of the base member 4 and thereafter prevent the cap 6 from being inadvertently flipped or pivoted to an open position until the two hook members 44 are again properly disengaged from the mating latching surfaces 48 of the base member 4.

Figure 2:
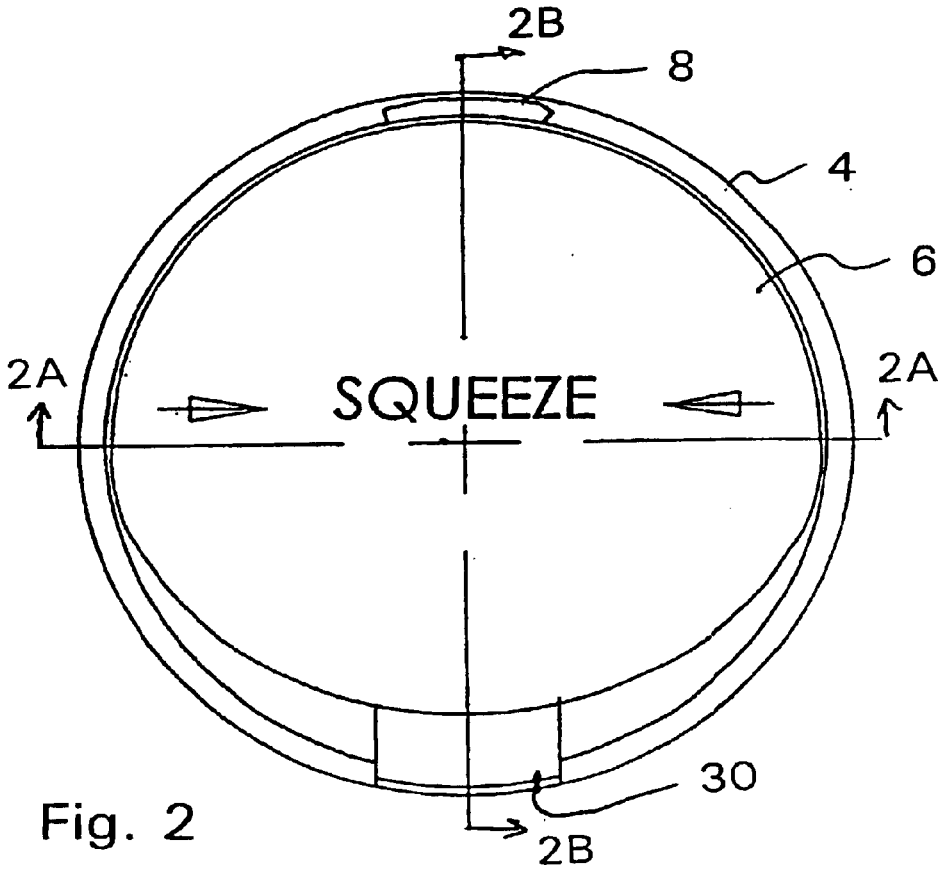
FIG. 2 is a diagrammatic top plan view of a second embodiment of the flip-top closure with a child resistant packaging system.
Figure 2A:
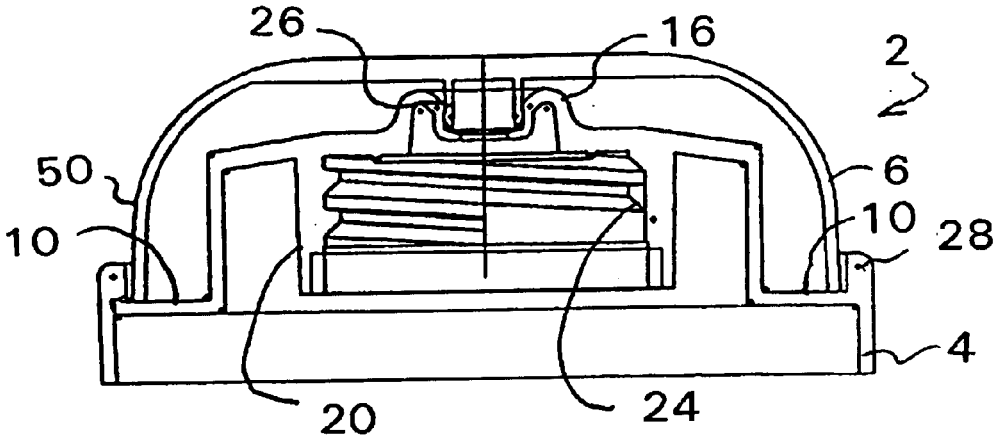
FIG. 2A is a diagrammatic cross sectional view along section line 2A—2A of FIG. 2.
Figure 2B:
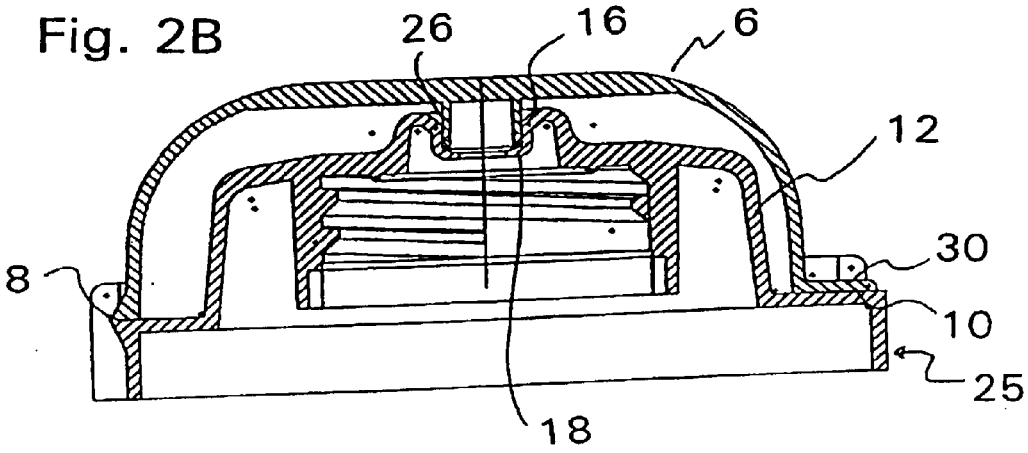
FIG. 2B is a diagrammatic cross sectional view along section line 2B—2B of FIG. 2.
Figure 2C:
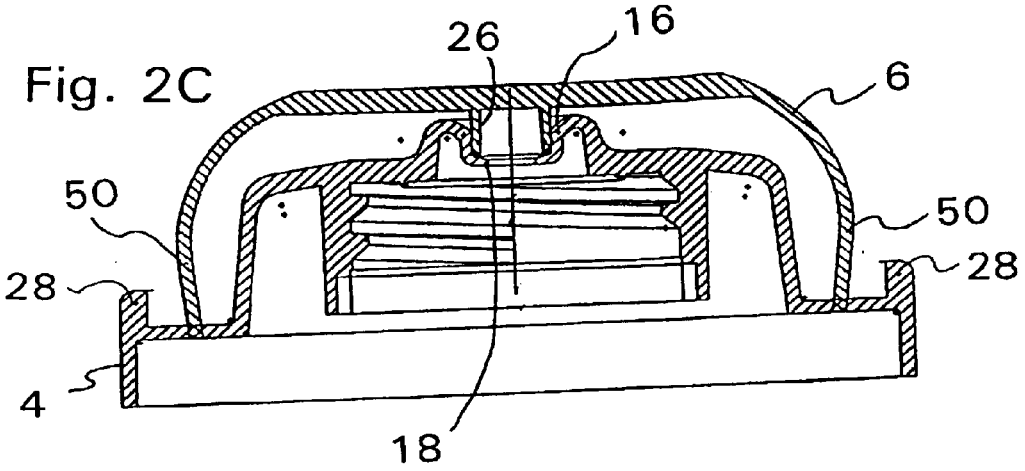
FIG. 2C is a diagrammatic cross sectional view, along section line 2A—2A of FIG. 2, showing the initial squeezing of the side walls of the cap to disengage the child resistant packaging system.
Figure 2D:
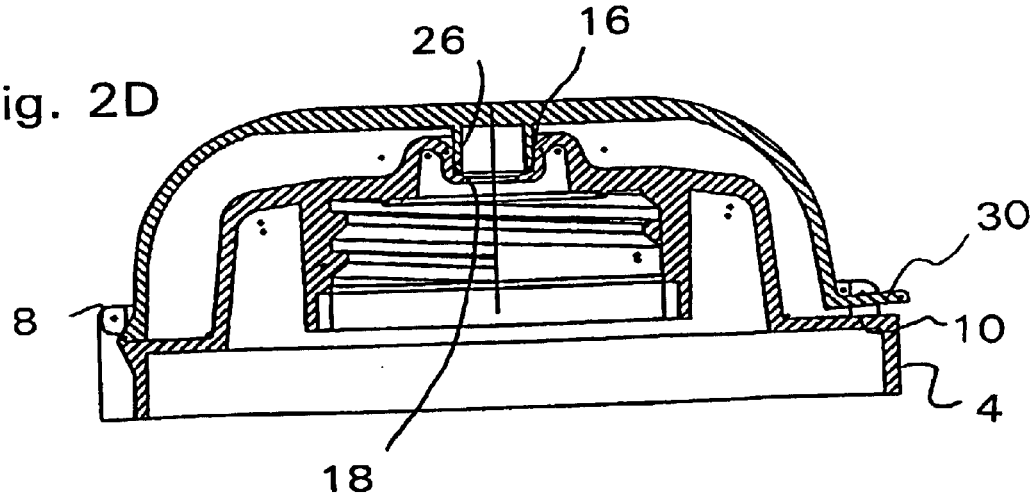
FIG. 2D is a diagrammatic cross sectional view, along section line 2B—2B of FIG. 2, showing the initial squeezing of the side walls of the cap to disengage the child resistant packaging system.
Figure 2E:
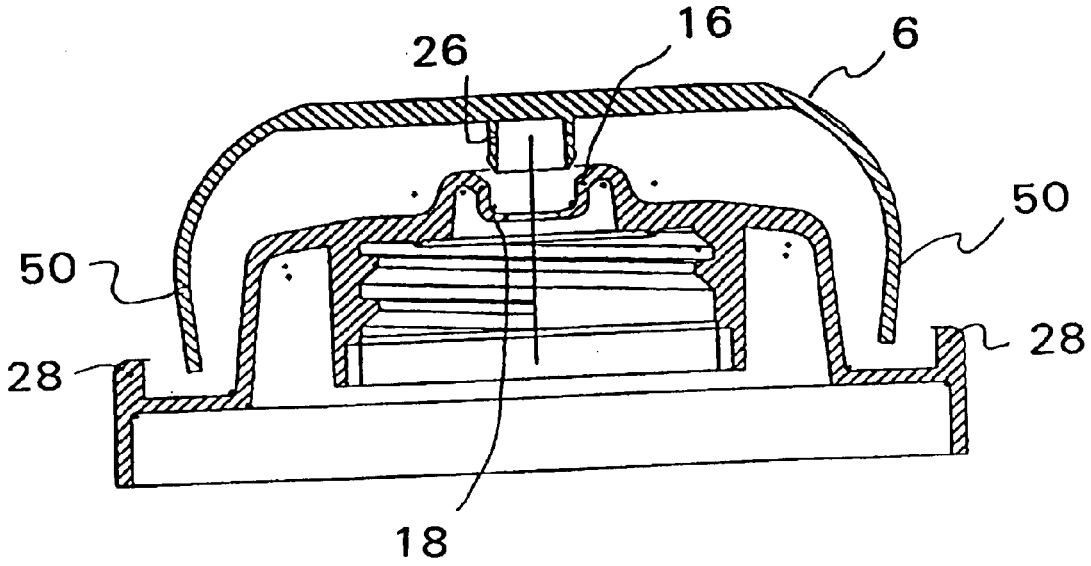
FIG. 2E is a diagrammatic cross sectional view, along section line 2A—2A of FIG. 2, showing an intermediate, partially pivoted position of cap relative to the base member.
Figure 2F:
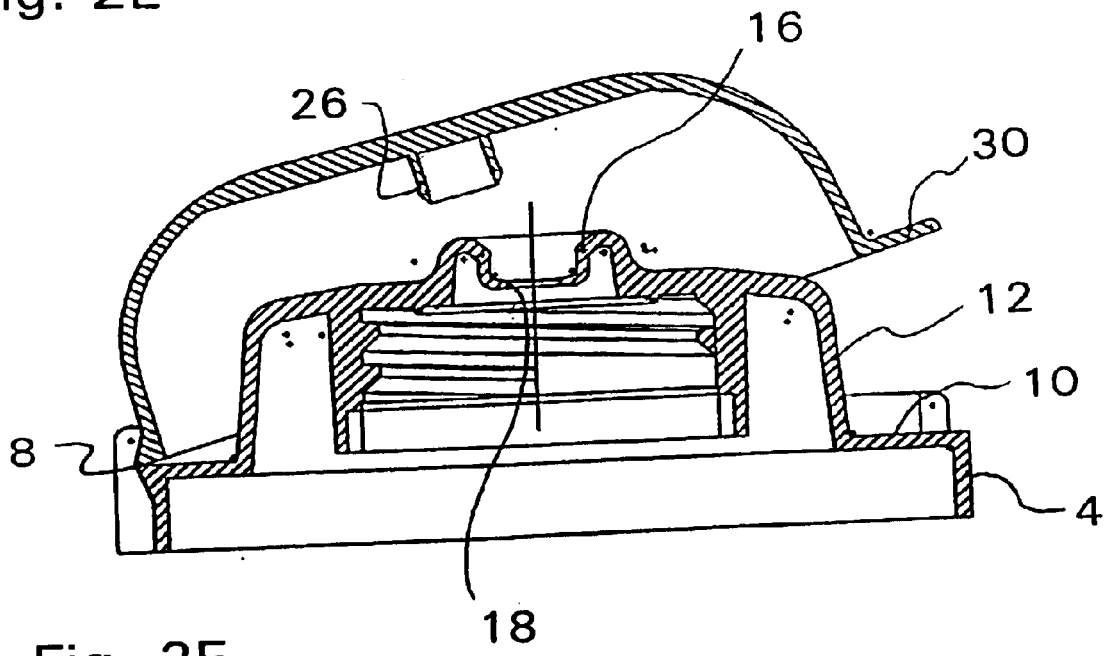
FIG. 2F is a diagrammatic cross sectional view, along section line 2B—2B of FIG. 2, showing an intermediate, partially pivoted position of cap relative to the base member.

Turning now to FIGS. 2–2F, a detailed description concerning a second embodiment of the flip-top closure 2 with a child resistance packaging system will now be described. It is to be appreciated that in the following description, the same elements will be provided with the same reference numerals.

The major difference between this embodiment and the first embodiment is that no hook member or aperture is provided, only a conventional handle component 30, the sealing member 26 and the annular rim 16 are provided as the locking feature. The handle component 30 is located 180° relative to, i.e., diametrically opposite, the hinge 8. The cap 6 has a generally oval configuration as can be seen in FIG. 2. The hinge 8 and the handle component 30 are located opposite one another along the closer sides of the oval shaped cap 6. A remote free end of the handle component 30 is generally flush with the cylindrical surface of the base member 4 so that the handle component 30 is in a generally retracted position and can not be readily gripped by the user. That is, the handle component 30 is generally not accessible by the user and this inhibits undesired opening of the closure.

As a result of this configuration, as opposed further spaced apart side walls of the oval shaped cap 6 are squeezed toward one another, in the direction of the two inwardly facing arrows of FIG. 2, those two opposed further spaced apart side walls move toward one another while the portions of the side walls supporting the hinge 8 and the handle component 30 move relative away from one another, i.e., become further spaced apart from one another. As the hinge 8 is fixedly connected to both the base member 4 and the cap 6, the side wall supporting the hinge 8 remains stationary while the opposite side wall supporting the handle component 30 does all of the moving and is squeeze away from the side wall supporting the hinge 8 so that the cap 6 assumes a generally circular shaped configuration. This circular shaped configuration of the cap 6 sufficiently extends the handle component 30 radially outward past the side wall of the base member 4 so the user can readily access and grip the handle component 30 and pivot the cap 6 into its open position in a conventional manner. The annular skirt 28 is provided with a recess area through which the handle component 30 extends when the further spaced apart side walls of the oval shaped cap 6 are squeezed toward one another. When the cap 6 is pivoted to its closed position, the handle component 30 is located generally flush with the annual skirt 28 within the recess and adjacent to the base surface 10. In the closed position the sealing member 26 engages with the mating annular rim 16 of the base surface 10 to lockingly retain the cap 6 in its closed position. Due to this arrangement, if an infant, child or some other young individual were to attempt to open the flip top closure 2 by merely attempting to pivot the cap 6 to its open position (not shown), there is nothing for the child to grasp, i.e., the handle component 30 is sufficiently retracted and the cap is difficult to grasp, thus not allowing sufficient leverage to grasp the cap 6 and disengage the sealing member 26 from the annular rim 16. As a result of this, the cap 6 is prevented from being pivoted to its open position, i.e., the sealing member 26 would remain sealingly engaged with the orifice 18.

In the event that dispensing of product from the container is desired by an appropriate user, e.g. a "normal" adult, the user squeezes the opposed further spaced apart side walls of the oval shaped cap 6 midway between the hinge 8 and the conventional handle component 30, radially inwardly toward the annular rim 16, so that the conventional handle component 30 is displaced radially outwardly due to its integral attachment to the sidewall 50. It is to be appreciated that the base surface 10 must not have any surface(s) or protrusion(s) that will inhibit the radial outward movement of the side wall of the cap 6 supporting the handle component 30 away from the hinge 8 as this will render the child resistant packaging system much more difficult for a "normal" adult to open. As a result of this squeezing action, the handle component 30 moves radially outward away from the sealing member 26 so that it sufficiently protrudes beyond the surfaces of both the base member 4 and the annular skirt 28 and is readily accessible. When the handle component 30 is in this extended position, this allows the user to readily grasp the handle component 30 and pivot the cap 6 into its open position, via the handle component 30 and the hinge 8, in a conventional manner and dispense of a desired amount of the product contents from the container via the flip-top closure 2. After the use of the product is completed, the user merely pivots and returns the cap 6 back to its closed position where the sealing member 26 once again sealingly engages with the orifice 18.

Upon returning the cap 6 back to its closed position, the return motion of the cap 6 generally properly aligns the cap 6 with the base member 4 to facilitate automatically achieving a locking engagement between the sealing member 26 and the annular rim 16. The cap 6 normally freely pivots toward its closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position the sealing member 26 engages with the annular rim 16 to close and lock the closure. It is to be appreciated that unless the cap 6 is squeezed, i.e. the further spaced side walls are squeeze toward one another, the cap 6 will generally be in its oval configuration as can be seen in FIG. 2.

Figure 3:
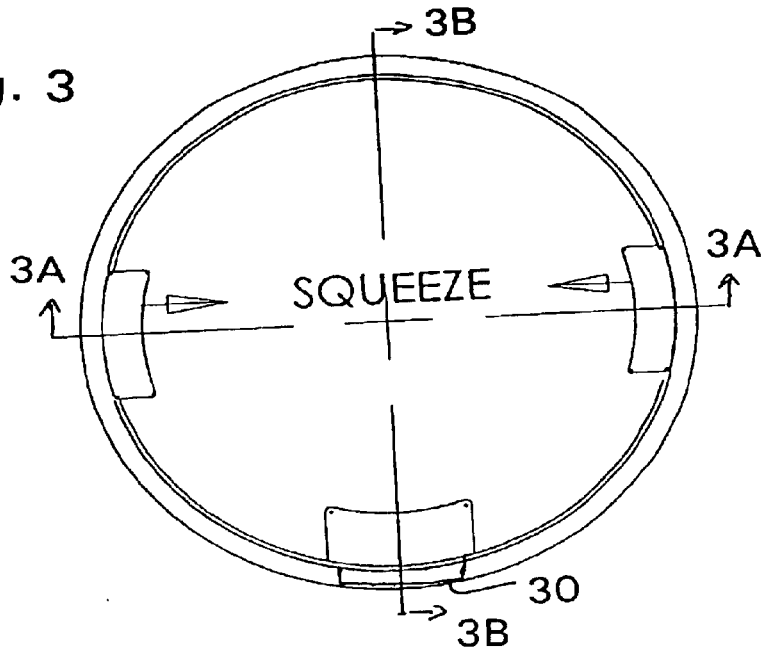
FIG. 3 is a diagrammatic top plan view of a third embodiment of the flip-top closure with a child resistant packaging system.
Figure 3A:
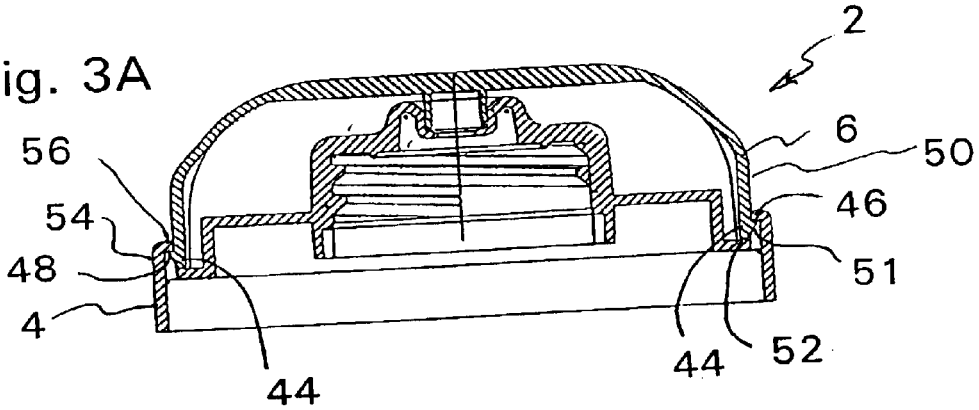
FIG. 3A is a diagrammatic cross sectional view along section line 3A—3A of FIG. 3.
Figure 3B:
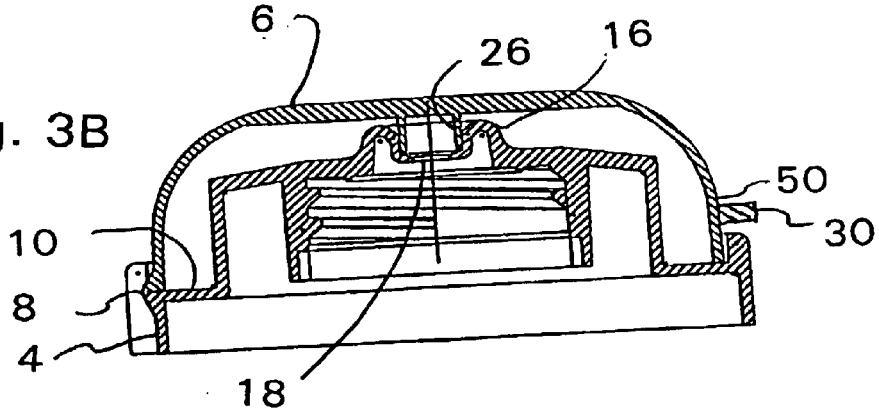
FIG. 3B is a diagrammatic cross sectional view along section line 3B—3B of FIG. 3.
Figure 3C:
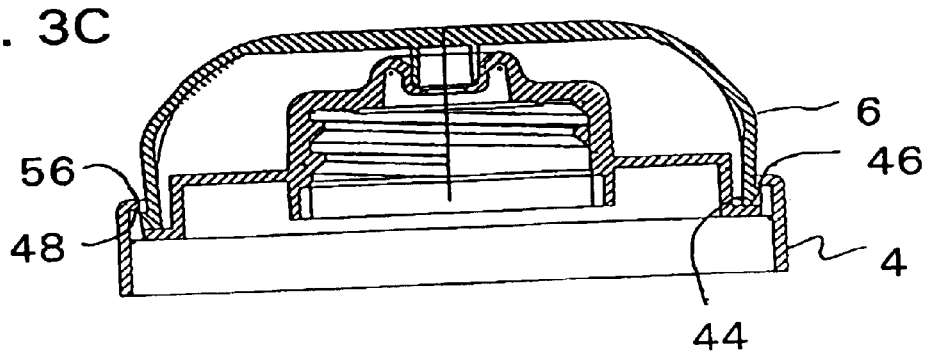
FIG. 3C is a diagrammatic cross sectional view, along section line 3A—3A of FIG. 3, showing the initial squeezing of the side walls of the cap to disengage the child resistant packaging system.
Figure 3D:
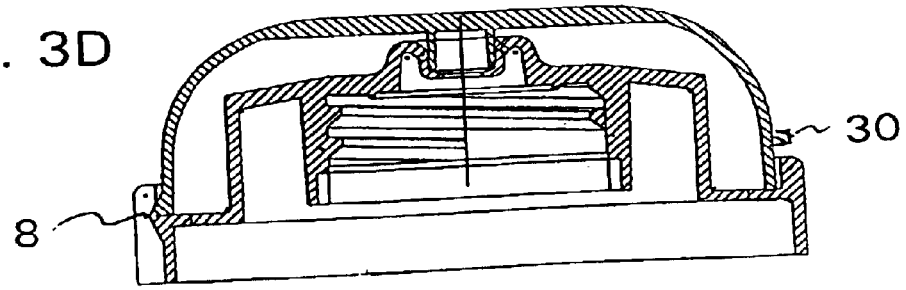
FIG. 3D is a diagrammatic cross sectional view, along section line 3B—3B of FIG. 3, showing the initial squeezing of the side walls of the cap to disengage the child resistant packaging system.
Figure 3E:
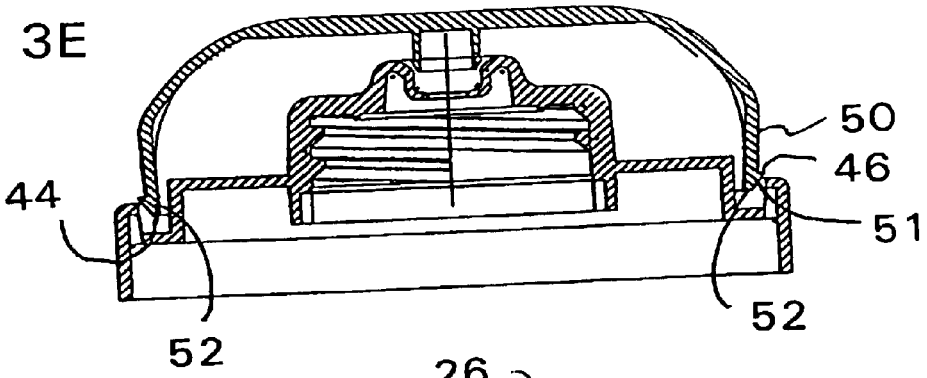
FIG. 3E is a diagrammatic cross sectional view, along section line 3A—3A of FIG. 3, showing an intermediate, partially pivoted position of cap relative to the base member.
Figure 3F:
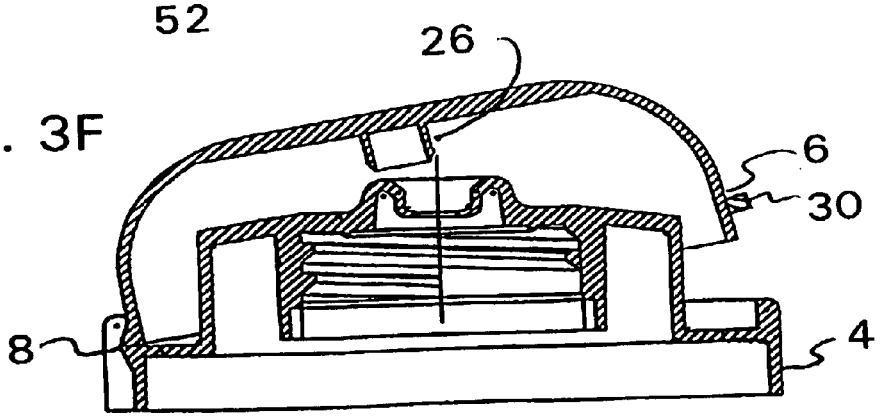
FIG. 3F is a diagrammatic cross sectional view, along section line 3B—3B of FIG. 3, showing an intermediate, partially pivoted position of cap relative to the base member.

With reference to FIGS. 3–3F, a detailed description concerning a third embodiment of the flip-top closure with a child resistance packaging system will now be described. It is to be appreciated that in the following description, the same elements will be provided with the same reference numerals.

As with the first embodiment, the cap 6 is provided with a pair of diametrically opposed mating hook members 44 while the base member 4 is provided with an annular shroud 54 which extends substantially around the entire perimeter of the base member 4. The annular shroud 54 has an inwardly directed annular edge 56 which extends radially inwardly and is located to engage with the respective latching ledges 46 of the hook members 44. The annular edge 56 may have a tapered or chamfered top surface (not shown) to facilitate the annular edge 56 receiving the respective hook members 44. An undersurface of the annular edge 56 forms a mating latching surface 48 which engages with the latching ledges 46 of the respective hook members 44 to provide the locking feature.

In the event that dispensing of product from the container is desired by an appropriate user, e.g., a "normal" adult, the user squeezes the opposed sidewalls to of the cap 6 supporting the hook members 44 radially inwardly toward one another a sufficient distance so that the hook members 44 are displaced radially inwardly due toward one another to their integral attachment to the sidewalls 50. It is to be appreciated that the base surface 10 must not have any surface(s) or protrusion(s) that will inhibit the radial inward movement of the hook members 44 toward one another as this will render the child resistant packaging system much more difficult for an adult to open. As a result of this squeezing action, the latching ledges 46 of the hook members 44 both move radially inwardly toward one another so that they no longer abut with the mating latching surface 48 of the annular edge 56. Once both of the latching ledges 46 of the hook members 44 are clear of the mating latching surface 48 of the annular edge 56, the user can then readily pivot the cap 6, via the handle component 30 and the hinge 8, into its open position in a conventional manner and dispense of a desired amount of the product contents from the container via the flip-top closure 2. After use of the product is completed, the user merely pivots and returns the cap 6 back to its closed position where the sealing member 26 once again sealingly engages with the orifice 18.

Upon returning the cap 6 back to its closed position, the return motion of the cap 6 generally properly aligns the cap 6 with the base member 4 to facilitate automatically achieving a locking engagement between the latching ledges 46 and the mating latching surface 48 of the annular edge 56. The cap 6 normally freely pivots toward its closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, a locking engagement is automatically achieved between the latching ledges 46 and the mating latching surface 48 of the annular edge 56. That is, as the cap 6 approaches its closed position (see FIGS. 3, 3A and 3B), the inclined surfaces 51 of the hook members 44 engages with the annular shroud 54 and bias the remote ends 52 of the hook members 44 radially inwardly toward one another until the remote ends 52 of the locking ledges 46 are sufficiently past the annular edge 56. Once the cap 6 is substantially returned back to its closed position such that the inclined surfaces 51 of the hook members 44 no longer engage with the annular shroud 54, the remote ends 52 of the hook members 44 spring radially outwardly, due to the inherent resiliency of the material from which the cap 6 and the hook member 44 are manufactured, so that the latching ledges 46 of the hook members 44 are again brought into locking engagement with the mating latching surface 48 of the annular shroud 54 and thereafter prevent the cap 6 from being inadvertently flipped or pivoted to the open position until the hook members 44 are disengaged from the mating latching surface 48 of the annular shroud 54.

Figure 4:
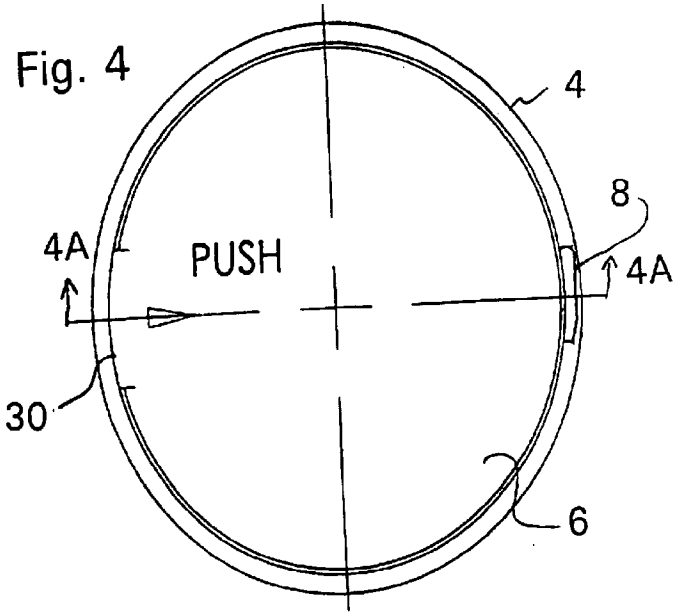
FIG. 4 is a diagrammatic top plan view of a fourth embodiment of the flip-top closure with a child resistant packaging system.
Figure 4B:
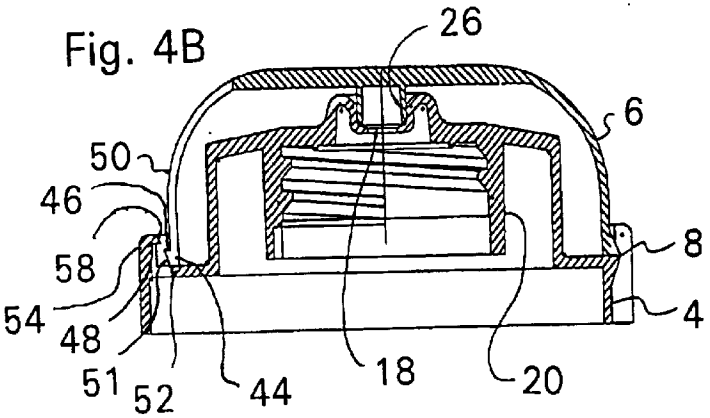
FIG. 4B is a diagrammatic cross sectional view, along section line 4A—4A of FIG. 4, showing the initial squeezing of the side walls of the cap to disengage the child resistant packaging system.
Figure 4C:
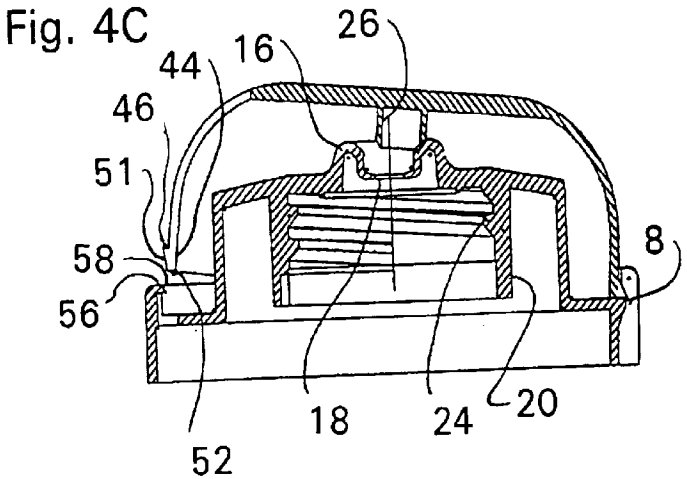
FIG. 4C is a diagrammatic cross sectional view, along section line 4A—4A of FIG. 4, showing an intermediate, partially pivoted position of cap relative to the base member.

With reference now to FIGS. 4–4C, a detailed description concerning a fourth embodiment of the flip-top closure with a child resistance packaging system will now be described. It is to be appreciated that in the following description, the same elements will be provided with the same reference numerals.

The major difference between this embodiment and the third embodiment is that only a single hook member 44 is provided and the single hook member 44 is located 180° relative to, i.e., diametrically opposite to, the hinge 8. As with the third embodiment, the base member 4 is provided with an annular shroud 54 which extends substantially around the entire perimeter of the base member 4. The annular shroud 54 has an inwardly directed annular edge 56 which extends radially inwardly and is located to engage the latching ledge 46 of the hook member 44. The annular edge 56 has a tapered or chamfered top surface 58 to facilitate the annular edge 56 receiving the hook member 44. An undersurface of the annular edge 56 forms mating latching surface 48 which engages with the latching ledge 46 of the hook member 44 to provide the locking feature.

In the event that dispensing of the product contents from the container is desired by an appropriate user, e.g., a "normal" adult, the user squeezes the sidewall 50 of the cap 6 opposite the hinge 8, radially inwardly toward the hinge 8, a sufficient distance so that the hook member 44 is displaced radially inwardly a substantially equal distance due to its integral attachment to the sidewall 50 (FIG. 4B). It is to be appreciated that the base surface 10 must not have any surface(s) or protrusion(s) that will inhibit the radial inward movement of the hook member 44 toward the hinge 8 as this will render the child resistant packaging system much more difficult for an adult to open. As a result of this squeezing action, the latching ledge 46 of the hook member 44 moves radially inwardly toward the hinge so that it is no longer in abutting engagement with the mating latching surface 48 of the annular edge 56. Once the latching ledge 46 of the hook member 44 is clear of the mating latching surface 48 of the annular edge 56, the user can then readily pivot the cap 6, via the handle component 30 and the hinge 8, into its open position in a conventional manner 50 (FIG. 4C) and dispense of a desired amount of product from the container, via the flip-top closure 2. Once the use of the product is completed, the user merely pivots and returns the cap 6 back to its closed position where the sealing member 26 once again sealingly engages with the orifice 18.

Figure 4A:
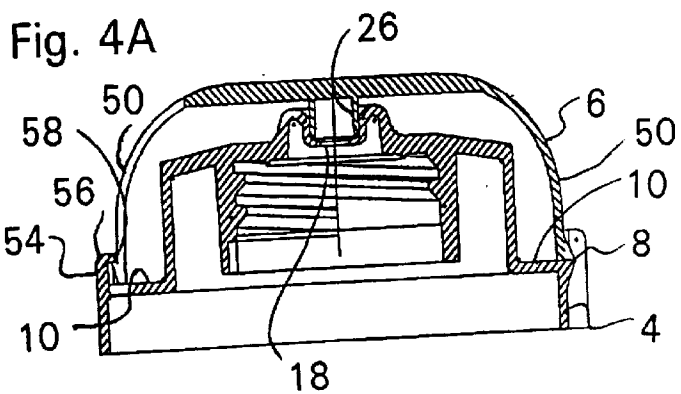
FIG. 4A is a diagrammatic cross sectional view along section line 4A—4A of FIG. 4.

Upon returning the cap 6 back to its closed position 50 (FIGS. 4 and 4A), the return motion of the cap 6 generally properly aligns the cap 6 with the base member 4 to facilitate automatically achieving a locking engagement between the latching ledge 46 and the mating latching surface 48 of the annular edge 56. The cap 6 normally freely pivots toward is closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, the inclined surface 51 of the hook member 44 engages with the tapered surface 58 of the annular edge 56 and biases the remote end 52 of the hook member 44 radially inwardly toward the hinge 8 until the locking ledge 46 is sufficiently past the annular edge 56. Once the cap 6 is substantially physically returned back to its closed position such that the inclined surface 51 of the hook member 44 no longer engages with the tapered surface 58 of the annular edge 56, the remote end 52 of the hook member 44 springs radially outwardly, due to the inherent resiliency of the material from which the cap 6 and the hook member 44 are manufactured, so that the latching ledge 46 of the hook member 44 is again brought into engagement with the mating latching surface 48 of the annular edge 56 and thereafter prevent the cap 6 from being inadvertently flipped or pivoted to an open position until the hook member 44 is disengaged from the mating latching surface 48 of the annular edge 56.

Figure 5:
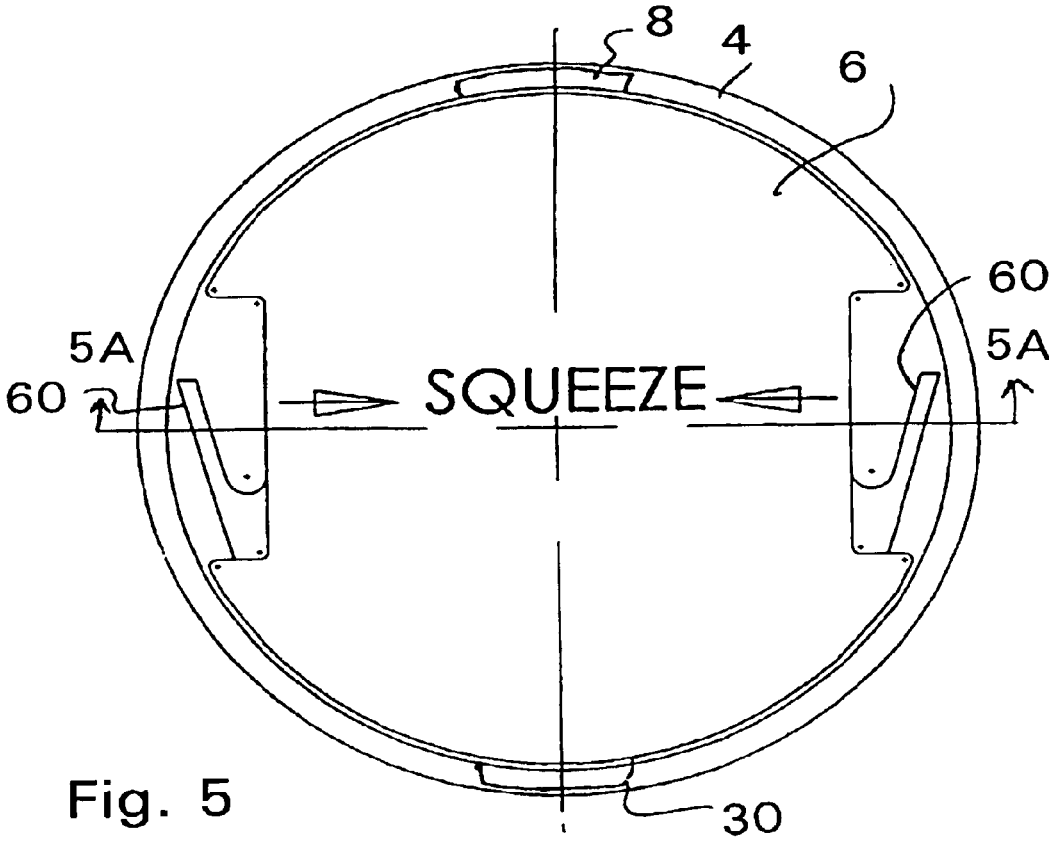
FIG. 5 is a diagrammatic top plan view of a fifth embodiment of the flip-top closure with a child resistant packaging system.
Figure 5A:
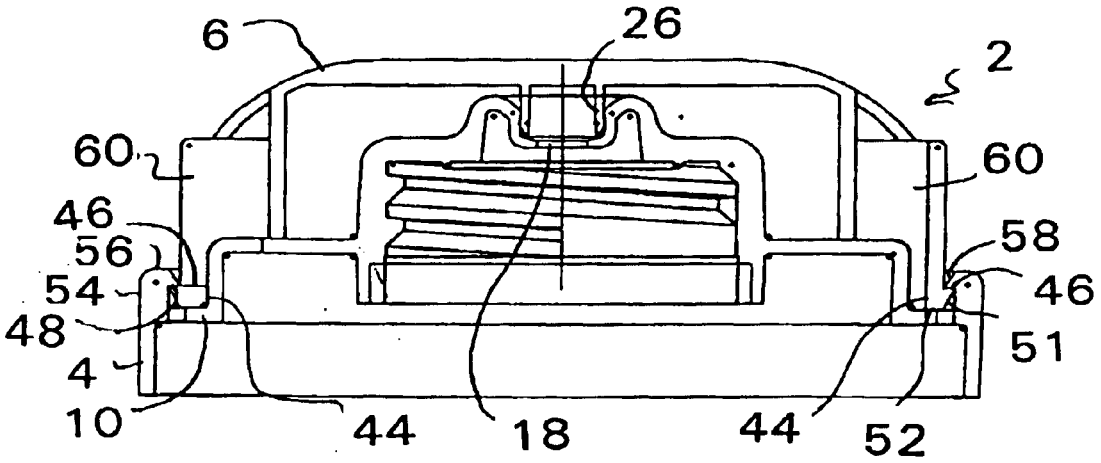
FIG. 5A is a diagrammatic cross sectional view along section line 5A—5A of FIG. 5.
Figure 5B:
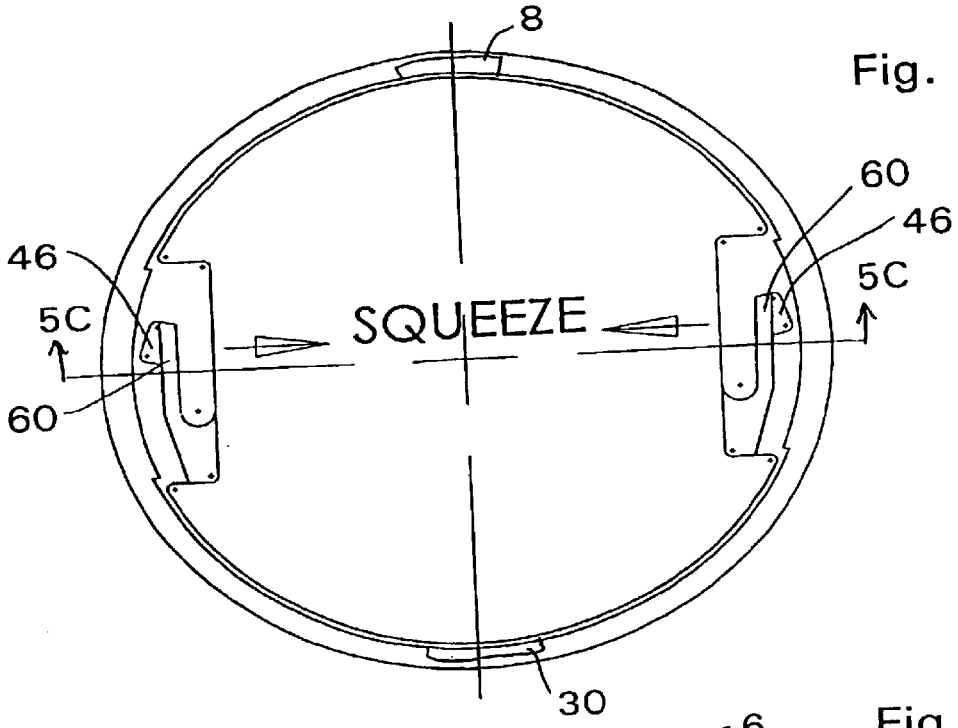
FIG. 5B is a diagrammatic top plan view of FIG. 5 showing the initial squeezing of the side walls of the cap to disengage the child resistant packaging system.
Figure 5C:
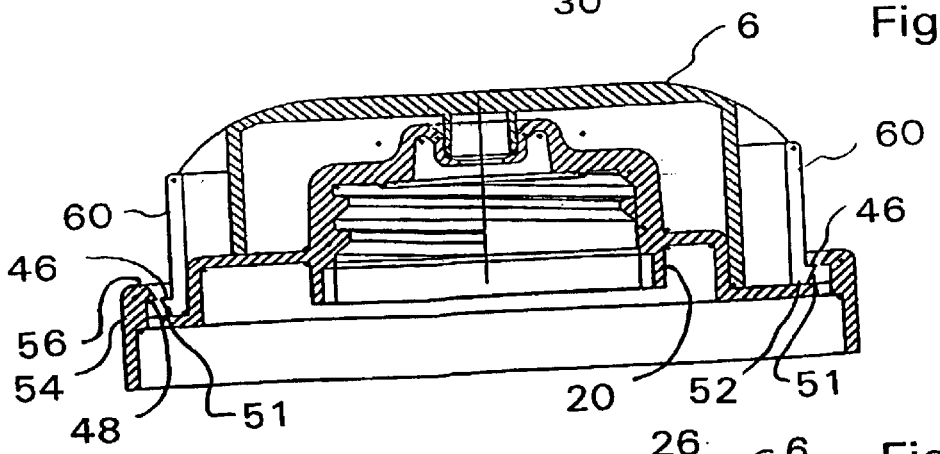
FIG. 5C is a diagrammatic cross sectional view, along section line 5A—5A of FIG. 5, showing the initial squeezing of the side walls of the cap to disengage the child resistant packaging system.
Figure 5D:
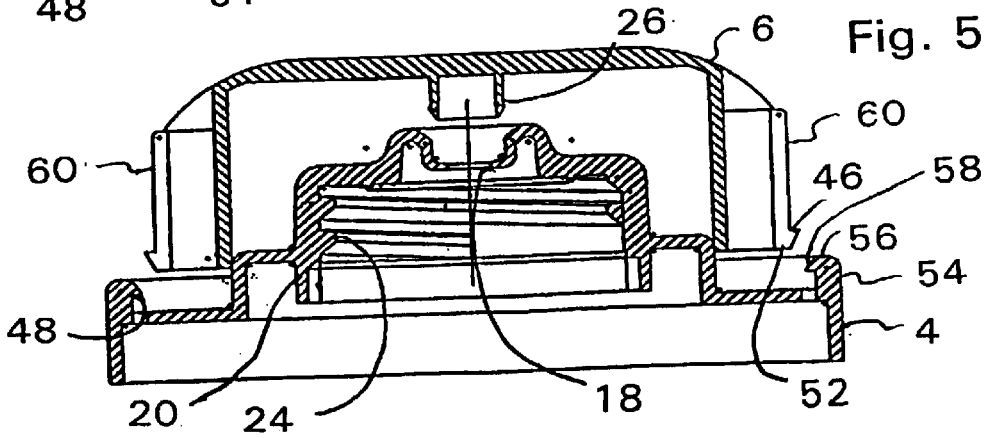
FIG. 5D is a diagrammatic cross sectional view, along section line 5A—5A of FIG. 5, showing an intermediate, partially pivoted position of cap relative to the base member.

Turning now to FIGS. 5–5D, a detailed description concerning a fifth embodiment of the flip-top closure with a child resistance packaging system will now be described. It is to be appreciated that in the following description, the same elements will be provided with the same reference numerals.

According to this embodiment, an exterior surface of the cap 6 is provided with a pair of diametrically opposed wings 60 that are generally equally spaced from both the hinge 8 and the handle component 30. A remote free end of each one of the wings 60 supports a downwardly facing hook member 44. The base member 4 is provided with an annular shroud 54 which extends substantially around the entire perimeter of the base member 4. The annular shroud 54 has an inwardly directed annular edge 56 which extends radially inwardly and is located to engage with the respective latching ledges 46 of the hook members 44. The annular edge 56 preferably has a tapered or chamfered top surface 58 to facilitate the annular edge 56 receiving the respective hook members 44 during closing of the cap 6. An undersurface of the annular edge 56 forms a mating latching surface 48 which engages with the latching ledges 46 of the respective hook member 44 to provide the locking feature for the system.

In the event that dispensing of product from the container is desired by an appropriate user, e.g., a "normal" adult, the user squeezes the opposed wings 60 of the cap 6 supporting the hook members 44, radially inwardly toward one another a sufficient distance so that the hook members 44 are displaced radially inwardly toward one another due to their integral attachment to the wings 60 (FIGS. 5B and 5C). It is to be appreciated that the base surface 10 must not have any surface(s) or protrusion(s) that will inhibit the radial inward movement of the hook members 44 toward one another as this will render the child resistant packaging system much more difficult for an adult to open. As a result of this squeezing action of the wings 60, the latching ledges 46 of the hook members 44 both move radially inwardly toward one another so that they no longer abut with the mating latching surface 48 of the annular edge 56. Once both of the latching ledges 46 of the hook members 44 are clear of the mating latching surface 48 of the annular edge 56, the user can then readily pivot the cap 6 (FIG. 5D), via the handle component 30 and the hinge 8, into its open position in a customary manner and dispense of a desired amount of product from the container via the flip-top closure 2. After use of the product is completed, the user merely pivots and returns the cap 6 back to its closed position where the sealing member 26 sealingly engages with the orifice 18.

Upon returning the cap 6 back to its closed position, the return motion of the cap 6 generally properly aligns the cap 6 with the base member 4 to facilitate automatically achieving a locking engagement between the latching ledges 46 and the mating latching surface 48 of the annular edge 56. The cap 6 normally freely pivots toward its closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, the inclined surfaces 51 of the hook members 44 engage with the tapered surface 58 of the annular edge 56 and bias the remote ends 52 of the hook members 44 radially inwardly toward one another until the locking ledges 46 are sufficiently past the annular edge 56. Once the cap 6 is substantially returned back to its closed position such that the inclined surfaces 51 of the hook members 44 no longer engage with the tapered surface 58 of the annular edge 56, the remote ends 52 of the hook members 44 spring radially outwardly, due to the inherent resiliency of the material from which the cap 6, the wings 60 and the hook member 44 are manufactured, so that the latching ledges 46 of the hook members 44 are again brought into locking engagement with the mating latching surface 48 of the annular edge 56 to prevent the cap 6 from being inadvertently flipped or pivoted to an open position until the hook members 44 are disengaged from the mating latching surface 48 of the annular edge 56.

Figure 6:
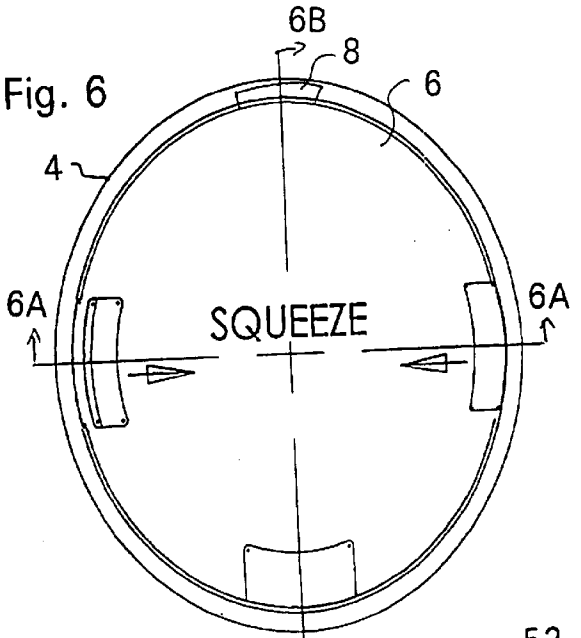
FIG. 6 is a diagrammatic top plan view of a sixth embodiment of the flip-top closure with a child resistant packaging system.
Figure 6A:
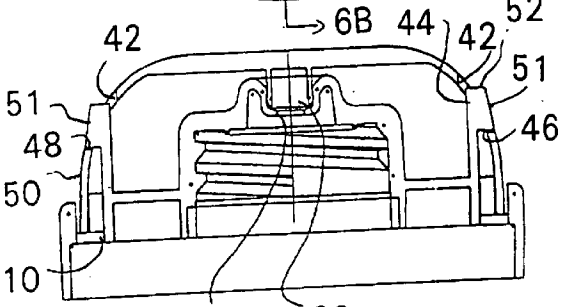
FIG. 6A is a diagrammatic cross sectional view along section line 6A—6A of FIG. 6.
Figure 7:
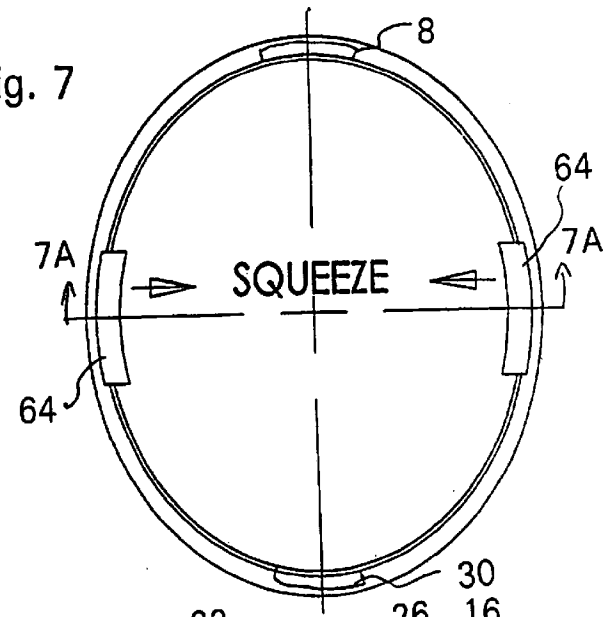
FIG. 7 is a diagrammatic top plan view of a seventh embodiment of the flip-top closure with a child resistant packaging system.
Figure 7A:
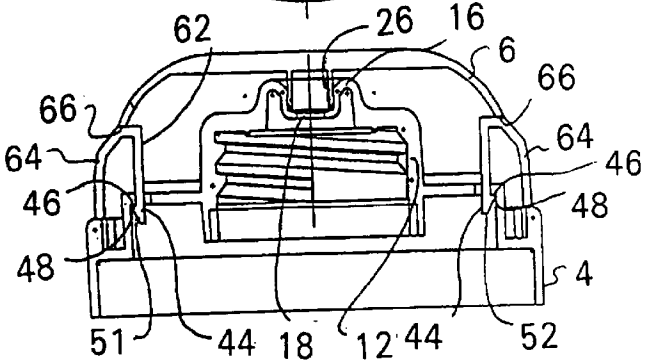
FIG. 7A is a diagrammatic cross sectional view along section line 7A—7A of FIG. 7.
Figure 6B:
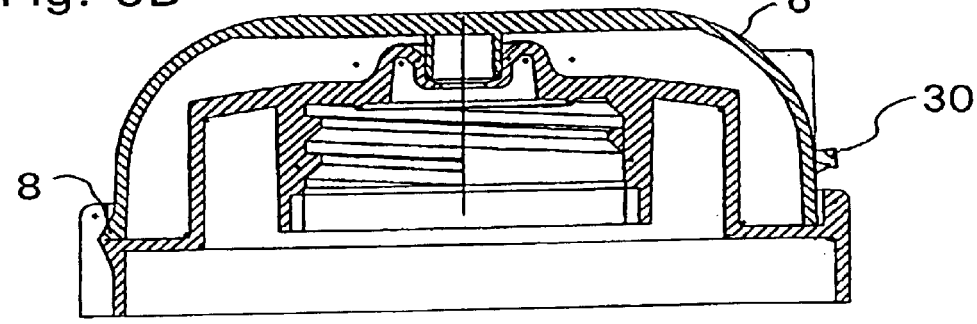
FIG. 6B is a diagrammatic cross sectional view along section line 6B—6B of FIG. 6.
Figure 6C:
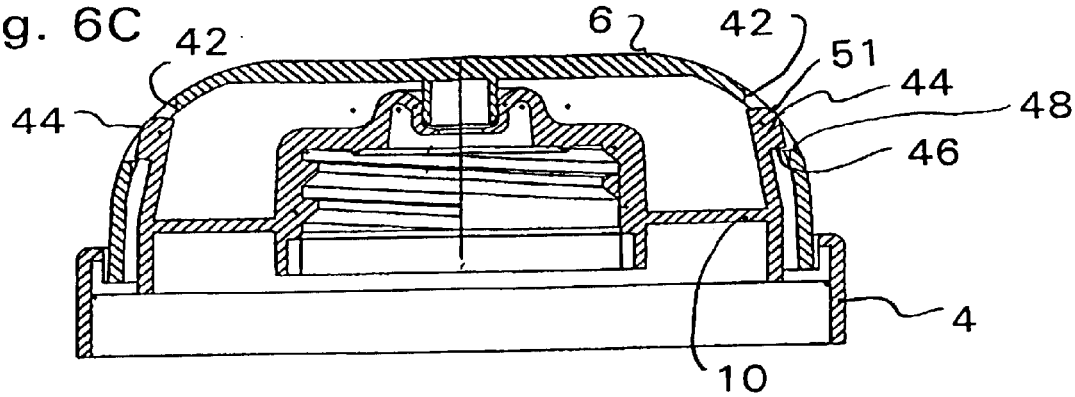
FIG. 6C is a diagrammatic cross sectional view, along section line 6A—6A of FIG. 6, showing the initial squeezing of the side walls of the cap to disengage the child resistant packaging system.
Figure 6D:
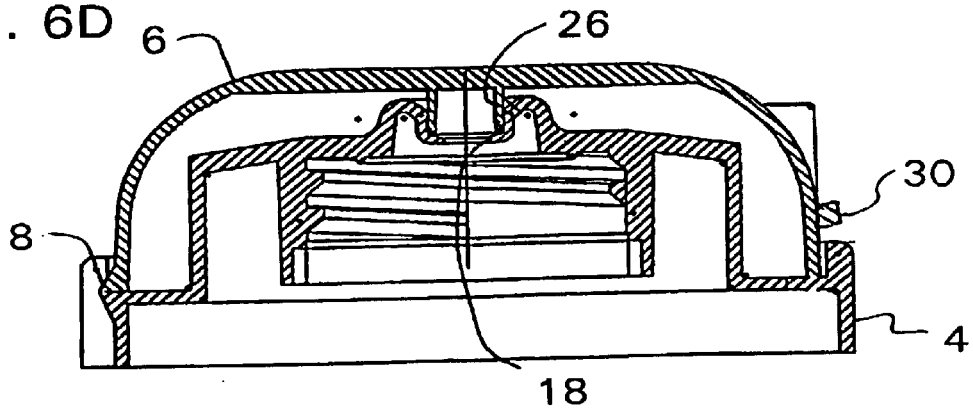
FIG. 6D is a diagrammatic cross sectional view, along section line 6B—6B of FIG. 6, showing the initial squeezing of the side walls of the cap to disengage the child resistant packaging system.
Figure 6E:
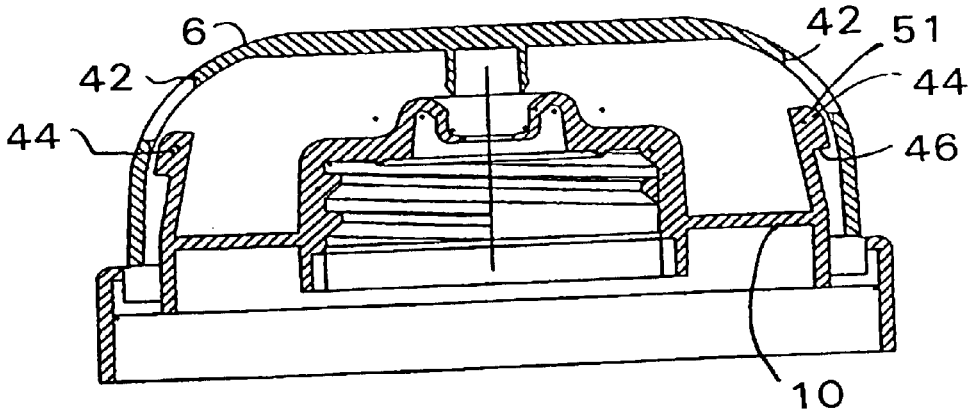
FIG. 6E is a diagrammatic cross sectional view, along section line 6A—6A of FIG. 6, showing an intermediate, partially pivoted position of cap relative to the base member.
Figure 6F:
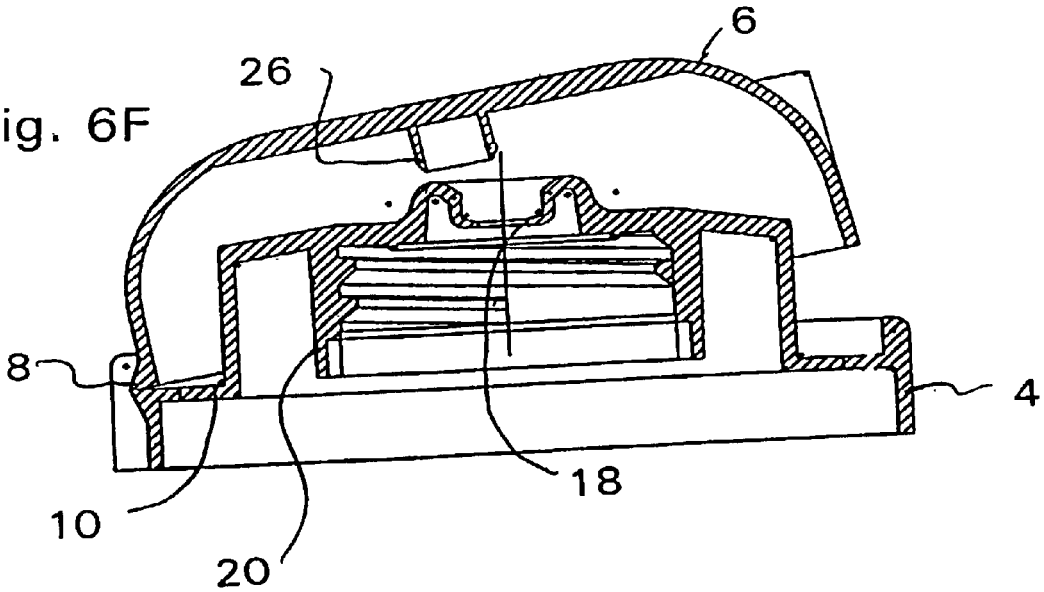
FIG. 6F is a diagrammatic cross sectional view, along section line 6B—6B of FIG. 6, showing an intermediate, partially pivoted position of cap relative to the base member.
Figure 7B:
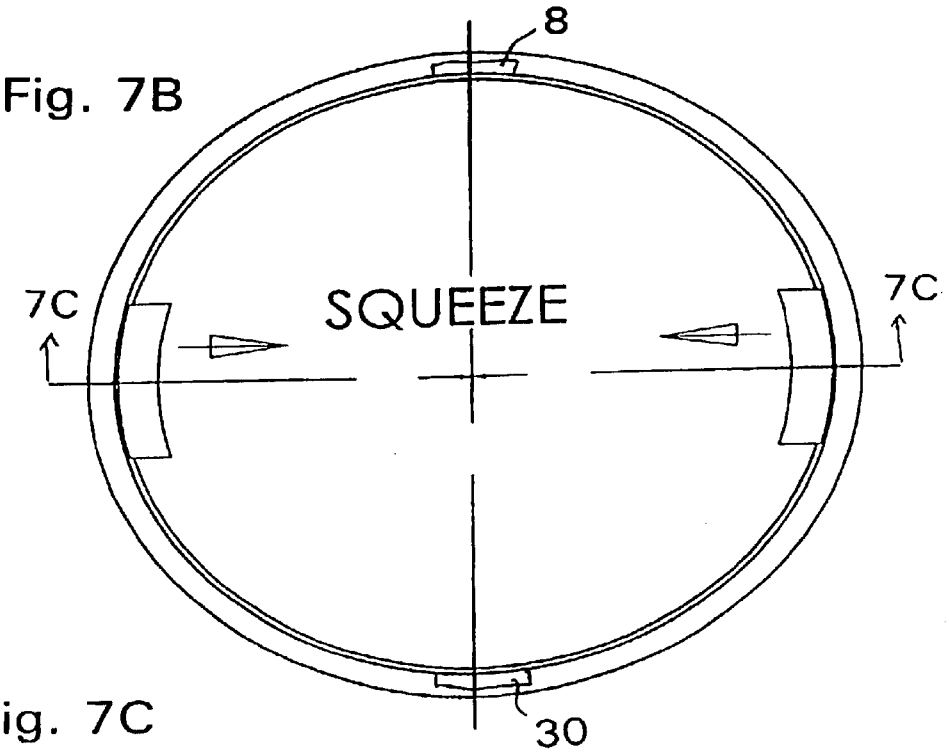
FIG. 7B is a diagrammatic top plan view of FIG. 7 showing the initial squeezing of the side walls of the cap to disengage the child resistant packaging system.
Figure 7C:
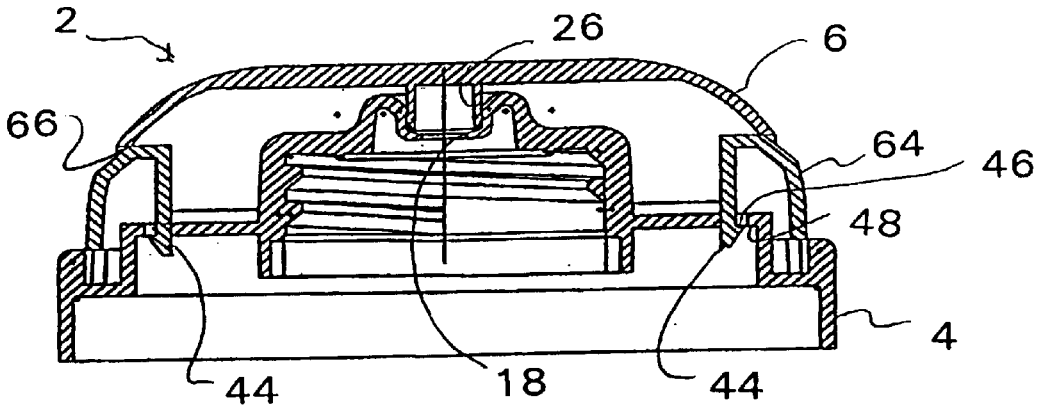
FIG. 7C is a diagrammatic cross sectional view, along section line 7A—7A of FIG. 7, showing the initial squeezing of the side walls of the cap to disengage the child resistant packaging system.
Figure 7D:
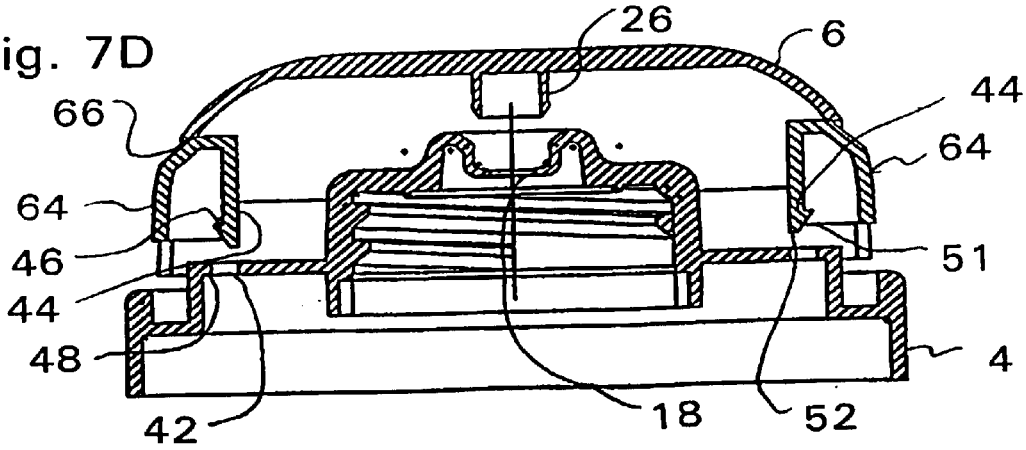
FIG. 7D is a diagrammatic cross sectional view, along section line 7A—7A of FIG. 7, showing an intermediate, partially pivoted position of cap relative to the base member.

With reference to FIGS. 6–6F, a detailed description concerning a sixth embodiment of the flip-top closure with a child resistance packaging system will now be described. It is to be appreciated that in the following description, the same elements will be provided with the same reference numerals.

According to the sixth embodiment, the arrangement of the aperture 42 and the hook members 44 are reversed. That is, the cap 6 is provided with the pair of apertures 42, while the base member 4 is provided with a pair of upstanding or protruding hook members 44. As can be seen in FIGS. 6, 6A, 6C and 6E, the apertures 42 are diametrically opposed from one another and are formed in the sidewall 50 of the cap 6. Both of the hook members 44 extend from a base surface 10 of the base member 4 and are shaped and located to matingly engage with a respective one of the two the apertures 42 provided in the cap 6 so as to retain the cap 6 in its closed and locked position (FIGS. 6, 6A and 6B). As with the previous embodiments, each one of the hook members 44 is provided with an inclined surface 51, at the free end thereof adjacent the latching ledge 46, to facilitate radial inward movement of the hook members 44 toward one another during the closing motion of the cap 6.

When a "normal" adult desires to dispense product from the container incorporating the flip-top closure 2, the user squeezes the exposed rounded or inclined surfaces 51 of the two hook members 44 toward one another until the latching ledges 46 of the hook members 44 are totally accommodated within an interior space defined by the cap 6 and slightly spaced from the latching surfaces 48 of the apertures 42. As a result of such squeezing action, the latching ledges 46 of the hook members 44 move sufficiently radially inwardly toward one another along so that they no longer abut with the mating latching surface 48 of the cap 6. Once the latching ledges 46 of the hook member 44 are clear of the latching surface 48 of the cap 6 (FIG. 6C), the user can readily pivot the cap 6, via the handle component 30 and the hinge 8, into its open position in a conventional manner and dispense a desired amount of product from the container via the flip-top closure 2. After use of the product is completed, the user merely pivots and returns the cap back to its closed position where the sealing member 26 sealingly engages the orifice 18 (FIGS. 6, 6A and 6B).

Upon returning the cap 6 back to its closed position, the return motion of the cap 6 generally properly aligns the cap 6 with the base member 4 to facilitate automatically achieving a locking engagement between the latching ledges 46 and the mating latching surfaces 48 of the cap 6. The cap 6 normally freely pivots toward its closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, an inclined surface 51 of each of the hook members 44 engages with an inwardly facing surface of the cap 6 and biases the remote end 52 of each respective the hook member 44 radially inwardly toward one another until the remote ends 52 of the hook members 44 are sufficiently received by and located within the apertures 42 formed in the cap 6. Once the cap 6 is substantially returned back to its closed position, each hook member 44 is sufficiently accommodated by each mating aperture 42 so that the inclined surface 51 of each respective hook member 44 is no longer engaged with the inwardly facing surface of the cap 6. As a result of this motion, the remote ends 52 of the hook members 44 both spring radially outwardly, due to the inherent resiliency of the material from which the base member 4, the cap 6 and the hook members 44 are manufactured, so that the latching ledge 46 of each hook member 44 is again brought into locking engagement with the mating latching surface 48 of the cap 6 to prevent the cap 6 from being inadvertently flipped or pivoted to an open position until the two hook members 44 are again properly disengaged from the mating latching surfaces 48 of the cap 6.

Due to this arrangement, when a "normal" adult desires to dispense product from the container incorporating the flip-top closure 2, the user will squeeze the oppose extension elements 64 radially inward toward one another a sufficient distance, e.g., a quarter inch or so, so that both of the hook members 44, supported adjacent the oppose extension elements 64, are displaced radially inward toward one another due to their integral attachment with the oval insert 62. It is to be appreciated that the base member 4 must not have any surface(s) or protrusion(s) that will inhibit radial movement of the hook members 44 toward one another as this will render the child resistant packaging system 40 much more difficult for a "normal" adult to open. As a result of this squeezing action of the opposed extension members 64, the oval insert 62 becomes generally circular in shape and the respective latching ledges 46 of the hook member 44 move radially inwardly toward one another so that they no longer abut with the mating latching surface 48 of the central section portion 12. Once the latching ledges 46 of the hook members 44 are clear of the mating latching surfaces 48 of the central portion 14, the user can readily pivot the cap 6, via the handle component 30 and the hinge 8, into its open position in a conventional manner and dispense a desired amount of product from the container via the flip-top closure 2. After use of the product is completed, the user merely pivots and returns the cap back to its closed position where the sealing member 26 sealingly engages the orifice 18.

Upon returning the cap 6 back to its closed position, the return motion of the cap 6 generally properly aligns the cap 6 with the base member 4 to facilitate automatically achieving a locking engagement between the latching ledges 46 and the mating latching surfaces 48 of the cap 6. The cap 6 normally freely pivots toward is closed position until the sealing member 26 generally commences contact with the annular rim 16 or the sealing member 26 is spaced from the annular rim 16 by a small distance. Once the cap 6 is in this pivoted position, the user must physically bias the cap 6 toward the base member 4 to fully close the cap 6 and engage the sealing member 26 with the annular rim 16. As the cap 6 is physically biased into its closed position, an inclined surface 51 of each of the hook members 44 engages with a surface of the base member 4 and biases the remote end 52 of each respective the hook member 44 radially inwardly toward one another until the remote ends 52 of the hook members 44 are sufficiently received by and located within the apertures 42 formed in the base member 4. Once the cap 6 is substantially returned back to its closed position, each hook member 44 is sufficiently accommodated by each mating aperture 42 so that the inclined surface 51 of each respective hook member 44 no longer engages with the base surface of the base member 4. As a result of this motion, the remote ends 52 of the hook members 44 both spring radially outwardly, due to the inherent resiliency of the material from which the base member 4, the cap 6 and the hook members 44 are manufactured, so that the latching ledge 46 of each hook member 44 is again brought into locking engagement with the mating latching surfaces 48 of the base member 4 and thereafter prevent the cap 6 from being inadvertently flipped or pivoted to an open position until the two hook members 44 are again disengaged from the mating latching surfaces 48 of the base member 4.

Preferably, the cap, the hinge, the base member, the insert member and the hook members are all manufactured from a resilient material. The resilient material can be, for example, polypropylene, polypropylene copolymer, polyethylene.

Since certain changes may be made in the above described improved flip top closure with a child resistance packaging system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A flip-top closure for dispensing a product from a container, the flip-top closure comprising:

a base member having a neck facilitating attachment of the base member to a desired container, and the base member having a dispensing orifice communicating with the neck to facilitate dispensing product from a container;

a cap formed integral with the base member and connected thereto by a hinge which facilitates pivoting motion of the cap relative to the base member, a handle component located opposite the hinge, and the cap being pivotable from an open position to a closed position and from the closed position to the open position; and the cap carrying a sealing member which facilitates sealing of the orifice when the cap is in the closed position;

wherein the flip-top closure includes a child resistant locking system which resists opening of the flip-top container by a child, the child resistant locking system comprises a releasable locking engagement between the dispensing orifice and the sealing member which facilitates retaining the cap in a locked position and resists opening of the flip-top container by a child when the cap is in the closed position and upon squeezing opposed side walls of the cap inwardly in a squeeze direction to decrease a diameter of the cap and increase a diameter of the cap in a direction extending normal the squeeze direction, the handle component is sufficiently extending radially away from the hinge to be accessible and facilitate disengagement of the sealing member from the dispensing orifice and movement of the cap to the open position.

2. The flip-top closure according to claim 1, wherein an aperture is formed in a base surface of the base member and a downwardly facing surface of the base member forms a latching surface.

3. The flip-top closure according to claim 1, wherein an annular rim is formed in a central most region of the base member and the annular rim defines the discharge orifice of the base member.

4. The flip-top closure according to claim 1, wherein a pair of apertures are formed in the cap and a base surface of the base member supports a pair of hook members.

5. The flip-top closure according to claim 1, wherein an annular shroud extends around a portion of a perimeter of the base member and the annular shroud has an inwardly extending annular edge, and the annular edge forms a latching surface.

6. The flip-top closure according to claim 1, wherein the cap has a pair of hook members and the base surface has a pair of mating apertures formed therein, and the mating apertures are located, when the cap is in the close position, to each receive a respective one of the hook members, and the hook members each having a latching ledge which engages with a latching surface of the mating apertures to lockingly retain the cap in the closed position.

7. The flip-top closure according to claim 6, wherein the hook members each have a remote end with an inclined surface, and the inclined surface of each respective hook member engages with the base member, upon returning the cap back to the closed position, to facilitate engagement between the hook member and the respective latching surface of the mating apertures.

8. The flip-top closure according to claim 1, wherein the cap, the hinge and the base member are all manufactured from a resilient material.

9. The flip-top closure according to claim 1, wherein the cap is provided with a pair of diametrically opposed hook members and the base member is provided with a pair of diametrically opposed apertures, the hook members are shaped and located to matingly engage with a respective one of the diametrically opposed apertures provided in the base member so as to retain the cap in the closed position, and each hook member is provided with an inclined surface, at the free end thereof, adjacent a latching ledge of the hook member, to facilitate radial inward movement of the hook members toward one another when returning the cap to the closed position.

10. The flip-top closure according to claim 1, wherein the cap is provided with a pair of diametrically opposed hook members and the base member is provided with an annular shroud which carries a pair of diametrically opposed apertures, the hook members are shaped and spaced to matingly engage with a respective one of the two the apertures provided in the base member so as to retain the cap in the closed position, and each hook member is provided with an inclined surface, at the free end thereof adjacent the latching ledge, to facilitate radial inward movement of the hook members toward one another when returning the of the cap to the closed position.

11. The flip-top closure according to claim 1, wherein the cap is provided with a pair of diametrically opposed apertures and the base member is provided with a pair of diametrically opposed hook members extending from a top surface of the base member, the hook members are shaped and spaced to matingly engage with a respective one of the diametrically opposed apertures provided in the cap so as to retain the cap in the closed position, and each hook member is provided with an inclined surface, at the free end thereof, adjacent a latching ledge of the hook member, to facilitate radial inward movement of the hook members toward one another when returning the of the cap to the closed position.

12. The flip-top closure according to claim 1, wherein the handle component is sufficient retracted from an outer perimeter of the base member so as to be inaccessible by a user for gripping the cap and pivoting the cap to the open position and disengaging the sealing member from its sealing engagement with the dispensing orifice.

13. The flip-top closure according to claim 1, wherein an exterior surface of the cap is provided with a pair of diametrically opposed wings, a remote free end of each one of the wings supports a hook member, and the base member is provided with an annular shroud which extends substantially around a perimeter of the base member, and the annular shroud has an inwardly extending annular edge which is located to engage with latching ledges of the hook members.

14. The flip-top closure according to claim 1, wherein the cap has an oval insert which is accommodated within the interior compartment defined by the cap, the oval insert supports a pair of diametrically opposed hook members which each have a latching ledge, the oval insert has a pair of diametrically opposed extension elements, and each extension element is located adjacent one of the hook members, and the base member supports a pair of apertures located to receive one of the pair of diametrically opposed hook members.

15. The flip-top closure according to claim 1, wherein the neck of the base member carries a thread and the desired container carries a mating thread which facilitate attachment of the base member to the desired container.

16. The flip-top closure according to claim 1, wherein the sealing member of the cap has an interference fit with the dispensing orifice which facilitates sealing engagement between the sealing member and the dispensing orifice when the cap is in the closed position.

17. The flip-top closure according to claim 1, wherein the cap, the hinge and the base member are all manufactured from a material selected from the group consisting of polypropylene, polypropylene copolymer, polyethylene.

18. The flip-top closure according to claim 1, wherein at least one hook member is carried by one of the base member and the cap and at least one latching surface is carried by the other of the base member and the cap, and the at least one hook member is located to engage with the at least one latching surface to retain and forms part of the child resistant locking system.

19. A flip-top closure for dispensing a product from a container, the flip-top closure comprising:

a generally cylindrical base member having a neck facilitating attachment of the base member to a desired container, and the base member having a dispensing orifice communicating with the neck to facilitate dispensing product from a container;

a generally oval shaped cap formed integral with the base member and connected thereto by a hinge which facilitates pivoting motion of the cap relative to the base member, a handle component located generally opposite to the hinge, and the cap being pivotable from an open position to a closed position and from the closed position to the open position, and the handle, when the cap is in its closed position, is retracted and is inaccessible by an user to facilitate pivoting of the cap to the open position and disengaging the sealing member from its sealing engagement with the orifice; and the cap carrying a sealing member which facilitates sealing of the orifice when the cap is in the closed position;

wherein the flip-top closure includes a child resistant locking system which resists opening of the flip-top container by a child, the child resistant locking system comprises a releasable locking engagement between the dispensing orifice and the sealing member which facilitates retaining the cap in a locked position and resists opening of the flip-top container by a child when the cap is in the closed position, and upon squeezing opposed side walls of the cap, substantially midway between the hinge and the handle component, radially inwardly toward one another to deform the cap into a substantially circular configuration, the handle component is sufficiently moved radially outwardly away from the hinge so as to be accessible for actuation by a user to facilitate opening of the flip-top closure.

20. The flip-top closure according to claim 19, wherein the base member has a substantially planar perimeter base surface contiguous with a central section, and the annular rim, which supports the discharge orifice, is formed in a central most region of the central section, and the central section supports the neck.

21. The flip-top closure according to claim 20, wherein the releasable locking engagement comprises an interference fit between the dispensing orifice and the sealing member.

22. The flip-top closure according to claim 20, wherein the hinge and the handle component are located opposite one another and the handle component is generally flush with the planar perimeter base surface of the base member so that the handle component is retracted and inhibits undesired opening of the closure.

23. The flip-top closure according to claim 22, wherein the hinge is fixedly connected to both the base member and the cap so that upon squeezing the opposed side walls of the cap, substantially midway between the hinge and the handle component, the side wall supporting the hinge remains substantially stationary while the opposite side wall supporting the handle component moves away from the hinge and extends sufficiently radially outward past an exterior side wall of the base member so as to be readily access.

24. The flip-top closure according to claim 20, wherein the base member has an annular skirt extending around an outer periphery thereof, and the annular skirt is provided with a recess area through which the handle component extends upon squeezing the opposed side walls of the cap substantially midway between the hinge and the handle component.

25. The flip-top closure according to claim 20, wherein the base surface is free of any surface or protrusion which inhibits the radial inward and outward movement of the side wall of the cap.

26. A method of providing a child resistant locking system for a flip-top closure, the method comprising the steps of:

providing a generally cylindrical base member with a neck facilitating attachment of the base member to a desired container, and forming a dispensing orifice in the base member communicating with the neck to facilitate dispensing product from a container;

forming a generally oval shaped cap integral with the base member via a hinge which facilitates pivoting motion of the cap relative to the base member, locating a handle component opposite the hinge and sufficiently retracting the handle component from an outer perimeter of the base member so as to be inaccessible to a user for actuating the cap, and the cap being pivotable by the handle component from an open position to a closed position and from the closed position to the open position;

providing the cap with a sealing member which facilitates sealing of the orifice when the cap is in the closed position;

providing a child resistant locking system comprising a releasable locking engagement between the dispensing orifice and the sealing member which facilitates retaining the cap in a locked position and resists opening of the flip-ton container by a child when the cap is in the closed position but permits squeezing opposed side walls of the cap, substantially midway between the hinge and the handle component, radially inwardly toward one another, so that the handle component is moved radially outwardly and becomes accessible for actuation by a user to facilitate opening of the flip-top closure.

* * * * *